US006241851B1

(12) United States Patent
Marcoccia

(10) Patent No.: US 6,241,851 B1
(45) Date of Patent: Jun. 5, 2001

(54) TREATMENT OF CELLULOSE MATERIAL WITH ADDITIVES WHILE PRODUCING CELLULOSE PULP

(75) Inventor: Bruno S. Marcoccia, Queensbury, NY (US)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

(21) Appl. No.: 09/248,009

(22) Filed: Feb. 10, 1999

Related U.S. Application Data

(60) Provisional application No. 60/076,628, filed on Mar. 3, 1998, and provisional application No. 60/083,581, filed on Apr. 30, 1998.

(51) Int. Cl.[7] ..... D21C 3/26

(52) U.S. Cl. ..... 162/19; 162/41; 162/76; 162/90

(58) Field of Search ..... 162/190, 41, 72, 162/26, 82, 90

(56) References Cited

U.S. PATENT DOCUMENTS

| | | | | |
|---|---|---|---|---|
| 2,944,928 | | 7/1960 | Kibrick et al. | 162/32 |
| 3,210,235 | | 10/1965 | Ferrigan, Jr. et al. | 162/30 |
| 3,888,727 | | 6/1975 | Kenig | 162/65 |
| 4,012,280 | | 3/1977 | Holton | 162/65 |
| 4,024,229 | | 5/1977 | Smith et al. | 423/562 |
| 4,091,749 | * | 5/1978 | Procter et al. | 162/25 |
| 4,127,439 | * | 11/1978 | Fuji et al. | 162/40 |
| 4,310,383 | * | 1/1982 | Fuji et al. | 162/37 |
| 4,599,138 | | 7/1986 | Lindahl | 162/19 |
| 5,489,363 | | 2/1996 | Marcoccia et al. | 162/43 |
| 5,536,366 | | 7/1996 | Marcoccia et al. | 162/42 |
| 5,547,012 | | 8/1996 | Marcoccia et al. | 162/42 |
| 5,575,890 | | 11/1996 | Prough et al. | 162/34 |
| 5,620,562 | | 4/1997 | Marcoccia et al. | 162/42 |
| 5,662,775 | | 9/1997 | Marcoccia et al. | 162/41 |

FOREIGN PATENT DOCUMENTS

| | | |
|---|---|---|
| 444274 | 9/1947 | (CA) . |
| 873779 | 6/1971 | (CA) . |
| 1324377 | 11/1993 | (CA) . |
| WO 98/13547 | 4/1998 | (WO) . |

OTHER PUBLICATIONS

Marcoccia et al, Lo–Solids® Cooking Continuous To Evolve: (the EAPC™ and M@™ Processes), 11 pages.

Lindstöm et al, "The effect of polysulfide pretreatment when kraft pulping to very low kappa numbers", Nordic Pulp and Paper Research Journal No. 1/1995, pp. 8–11.

Sanyer et al, "Factors Affecting Yield Increase and Fiber Quality in Polysulfide Pulping of Loblolly Pine, Other Softwoods, and Red Oak", Tappi, vol. 47, No. 10, Oct. 1964, pp. 640–651.

Jiang et al and Lowe et al, "Extended Modified Cooking of Southern Pine and Polysulfide—Effect on Elemental–Chlorine–Free Bleaching", Poster Presentation at the 1994 International Pulp Bleaching Conference, Vancouver, Canada, Jun. 13–16, 8 pages.

(List continued on next page.)

*Primary Examiner*—Dean T. Nguyen
(74) *Attorney, Agent, or Firm*—Nixon & Vanderhye P.C.

(57) ABSTRACT

Chemical cellulose pulp (e.g. kraft pulp) is produced with enhanced strength and/or yield using a strength or yield enhancing additive such as polysulfide or anthraquinone or its equivalents or derivatives, and in a manner that allows effective recovery/reuse of the additive so as to make the process more economical. In a continuous digester a low temperature and relatively low alkalinity protecting zone is provided at the top of the digester terminating with a first screen, and a second screen is provided below the first screen. Between the first and second screens, prior to bulk delignification, a first counter-current zone is provided, and additive-containing liquid from the first screen is recirculated to the slurry at or near the digester inlet to enhance yield or strength.

29 Claims, 5 Drawing Sheets

OTHER PUBLICATIONS

Jameel et al, "Extending delignification with AQ/polysulfide", Tappi Journal, vol. 78, No. 9, Sep. 1995, pp. 151–160.
Li et al, "The Modification of Multi–Stage Polysulfide Pulping to Improve Pulping Selectivity", Pulp and Paper Research Institute of Canada, Quebec, Canada, H9R 3J9, 6 pages.
Osmo Pekkala, "On the extended delignification using polysulfide or anthraquinone in kraft pulping", Paper and Timber, vol. 11, 1982, pp. 735–744.
Tench et al, "Mill Scale Implementation of Paprican's Process for Polysulfide Liquor Production in Kraft Mill Causticizers—Part 1: Batch Trials and Process Optimization", 1998 Pulping Conference, pp. 571–592.
Hu et al, "Polysulfide Pulping of Softwood Using Oxidized Mill White Liquor Generated from Paprican's PS Process", 1998 Pulping Conference, pp. 561–569.
Blain et al, "AQ Pulping: Towards the 21$^{st}$ Century", 1998 Pulping Conference, pp. 61–93.
Kleppe et al, "Sulphate Pulping by the Polysulphide Process", *Norsk Skogindustri*, 11/63, pp. 428–440.
Taga et al, "Two–Stage Cooking Process by the Use of Polysulfides and Alkaline Cooking Liquor" *The High Yield Chemical Pulping Process by the Use of Polysulifides Part 2*, pp. 27–32.
Miyao et al, "Stabilization of Cellulose to Hot Alkaline Solution by Treatment with Polysulfide", *Studies on Polysulfide Cooking. III.*, pp. 121–127.
Miyao et al, "Stabilization of Hemicellulose to Hot Alkaline Solution by Treatment with Polysulfide", *Studies on Polysulfide Cooking. V.*, pp. 202–207.
Teder, "The Effect of Lignin on the Stability of Polysulfide Solutions", *Svensk Papperstidning*, Nr. 23, Dec. 15, 1965, pp. 825–833.
Landmark et al, "Cooking Liquor Oxidation and Improved Cooking Technique in Polysulfide Pulping", *TAPPI*, vol. 48, No. 5, May 1965, pp. 56A–58A.
Dillén et al, "On the Influence of Sulphidity and Alkali Charge in Kraft and Polysulphide Pulping of Scots Pine", *Svensk Papperstidning*, Nr 4, Feb. 28, 1967, pp. 122–134.
Olsson et al, "Inorganic Reactions During Polysulifide Cooking", *Svensk Papperstidning*, N4. 20, Oct. 31, 1966, pp. 703–710.
Clayton et al, "Multi–Stage Polysulphide Pulping Processes", *Pulp and Paper Magazine of Canada*, Dec., 1967, pp. T–619–T630.
Järvelä et al, "Influence of Cooking Conditions in Two–Stage Polysulfide Pulping", *TAPPI*, vol. 50, No. 3, Mar. 1, 1967, pp. 147–150.
Hartler, "Recent Experiences in Polysulfide Cooking", *TAPPI*, vol. 50, No. 3, Mar. 1967, pp. 156–160.
Ekman et al, "Influence of Cooking Conditions in Two–Stage Polysulfide Pulping", *TAPPI*, vol. 50, No. 2, Feb. 1967, pp. 75–77.
Teder, "Redox Potential of Polysulfide Solutions and Carbohydrate Stabilization", *Svensk Papperstidning*, Nr. 5, Mar. 15, 1968, pp. 149–160.
Sanyer, "Progress and Prospects of Polysulfide Pulping", *TAPPI*, vol. 51, No. 8, Aug. 1968, pp. 48A–51A.
Barker, "Generation of Polysulfide From Standard Kraft Liquor", *TAPPI*, vol. 53, No. 6, Jun. 1970, pp. 1087–1090.
MacLeod, "Kraft Pulping Variables", *TAPPI*, May 10, 1995, Abstract and pp. 1–75.
Hägglund, "Slutgiltig gestaltning av byggnader och apparatutrustning i CCL:s försöksavdelningar i Svenska Träforskningsinstitutet", *Svensk Papperstidning*, Nr. 5, May 15, 1946, pp. 191–204.
Renard et al, "Analysis of Anthraquinone Impact on Alkaline Pulping Processes", *The American Institute of Chemical Engineers*, 1980, pp. 182–189.
Holton et al, "Anthraquinone Pulping Process and Supply Considerations", *Fall Conference on Raw Materials and Engergy*, San Francisco, California, Nov. 1, pp. 1–24.
Green, "Polysulfide Liquor Generation and White Liquor Oxidation", pp. 257–268.
Kleppe, "Polysulfide pulping in a dual–vessel Kamyr digester", *TAPPI*, vol. 58, No. 8, Aug. 1975, pp. 172–176.
Hilmo, "World's only commercial polysulfide mill reveals advantages and problems", *Pulp & Paper*, pp. 73–76.
Blain et al, "Economics of Aq pulping: The net value of increased production", *Pulp & Paper Canada*, 1983, pp. 58–63.
Holton, "Soda additive softwood pulping: a major new process", *Pulp & Paper Canada*, Oct. 10, 1977, pp. 19–24.
Mattar et al, "AQ radicals in alkaline pulping", *TAPPI*, vol. 64, No. 4, Apr. 1981, pp. 136–137.
Hanson et al, "Anthrazuinone pulping . . . is it magic?", *Pulp & Paper*, May 1978, pp. 86–90.
Kettunen et al, "A Case study—converting a kraft mill into a NSAQ mill", *TAPPI Journal*, Oct. 1982, pp. 63–67.
Abbott et al, "Kinetics of soda–anthraquinone delignification", *TAPPI Journal*, Sep. 1982, pp. 127–129.
Werthmann, "Sulfide and anthraquinone–like catalysts delignify wood via different chemical mechanisms in alkaline pulping", *TAPPI*, vol. 65, No., Jul. 1982, pp. 98–101.
Stradal et al, "70%–yield alkaline sulfite–anthraquinone pulp for linerboard", *TAPPI Journal*, vol. 66, No. 10, pp. 75–79.
Eachus, "Effect of soda–anthraquinone pulping conditions on holocellulose fibers", *TAPPI Journal*, Feb. 1983, pp. 85–88.
Furuya, "9% production gain with quinone–additive kraft pulping in a batch digester", *TAPPI Journal*, Jun. 1984, pp. 82–85.
Eckert et al, "Soda anthraquinone pulping of Douglas fir", *TAPPI Journal*, Nov. 1984, pp. 104–108.
Kent et al, "Low Sulfidity Kraft–Anthraquinone Pulping of Hardwood/Softwood Mixtures", *TAPPI Proceedings*, 1983, pp. 69–77.
Green et al, "The Use of Quinone Additives in Kraft and Polysulfide Pulping", *TAPPI Proceedings*, 1983, pp. 79–84.
MacLeod, "A Review of New Alkaline–Aq Processes", *TAPPI Proceedings*, 1983, pp. 89–91.
MacLeod, "Alkaline sulfite–anthraquinone pulp from aspen", *TAPPI Journal*, Aug. 1986, pp. 106–109.
Sanborn et al, "An evaluation of the sulfite–AQ pulping process", *TAPPI Journal*, Aug. 1986, pp. 102–105.
Malachowski et al, "The effects of anthraquinone on the reaction rate of the kraft pulping of Northeastern white pine", *TAPPI Journal*, Jun. 1989, pp. 207–210.
Ringley, "Westvaco Uses Anthraquinone To Increase Alkaline Pulp Yields", *Pulping Chemicals*, two pages.
Blain et al, "Anthraquinone Pulping: Fifteen Years After", *TAPPI Proceedings*, 1992, pp. 1005–1014.
Wozniak et al, "Lignin–Derived Quinones as Pulping Additives", *Journal of Wood Chemistry and Technology*, 1989, pp. 535–548.

Kleppe, "Polysulfide AQ Pulping and Oxygen Dramatically Boost Yield, Capacity", *Bleaching Technology*, pp. 132–136.
Rajan et al, "Extending the Digester Delignification with Anthraquinone", *TAPPI Proceedings*, 1992, pp. 985–1004.
Goyal et al, "Anthraquinone—A Simple Approach for Extended Delignification in Conventional Kraft Pulping", *TAPPI Proceedings*, 1992, pp. 1047–1053.
Sturgeoff et al, "Low–kappa pulping without capital investment: using anthraquinone for low–kappa pulping", *TAPPI Journal*, vol. 77, No. 7, Jul. 1994, pp. 95–100.
Ghosh et al, "Soda–anthraquinone pulping of hardwoods", *TAPPI*, vol. 61, No. 8, Aug. 1978, pp. 57–59.
Leu et al—"Kraft and soda pulping of decayed western hemlock using anthraquinone", *TAPPI*, vol. 63, No. 1, Jan. 1980, pp. 82–83.
Kleppe, "A mill trial with the addition of a small amount of AQ to kraft and polysulfide pulping", *Paperi ja Puu*, No. 4, 1981, pp. 204–210.
Venemark, "Some Ideas on Polysulfide Pulping", *Svensk Papperstidning*, Nr. 5, Mar. 15, 1964, ten pages.
Chivukula etg al, "Effect of Pretreatment with Green Liquor, AQ and Polysulfide on the Performance of an Extended Batch System", *TAPPI Proceedings*, 1998, pp. 419–429.
Hakanen et al, "Modified kraft cooking with polysulfide: yield, viscosity, and physical properties", *TAPPI Journal*, vol. 80. No. 7, Jul. 1997, pp. 189–196.
Berthold et al, "Polysulfide addition as a means to increase delignification in kraft pulping", *Nordic Pulp and Paper Research Journal*, vol. 12, No. 4/ 1997, pp. 230–236.
Dahlbom et al, "The characteristics of MSS–AQ pulping—a new pulping process", *TAPPI Journal*, Mar. 1990, pp. 257–261.
Burazin et al, "Building a mechanistic model of kraft–anthraquinone pulping kinetics", *TAPPI Journal*, Mar. 1988, pp. 165–169.
MacLeod et al, "The strengths of kraft–AQ and soda–AQ pulps—Bleachable–grade pulps", *TAPPI*, vol. 63, No. 1, Jan. 1980, pp. 57–60.
Mortimer et al, "Substituting AQ for AA in kraft pulping", *TAPPI Journal*, vol. 68, No. 10, Oct. 1985, pp. 111–113.
Green et al, "Polysulphide pulping of two Canadian softwood blends", *Pulp & Paper Canada*, 76, No. 9, Sep. 1975, 4–page reprint.
8–page brochure of Mead Chemical Systems entitled "MOXY System I".
Smith et al, "Polysulfide Liquor Generation with Moxy System I", *TAPPI Proceedings*, 1974, 15 pages.
Kleppe, "Polysulfide pulping in a dual–vessel Kamyr digester", *TAPPI*, vol. 58, No. 8, Aug. 1975, pp. 172–176.
Teder et al, "Low–kappa–number polysulfide pulps are easy to bleach", *TAPPI*, vol. 64, No. 4, Apr. 1981, pp. 138–139.
Kleppe, "Polysulfide AQ Pulping and Oxygen Dramatically Boost Yield, Capacity", *Pulp & Paper*, Jun. 1988, pp. 49–53.
Hara, "New Polysulfide Pulping Process at Shirakawa and Hachinohe", *TAPPI Proceedings*, 1991, pp. 107–113.
Ghosh, "Evaluation of Anthraquinone Additives in Soda Pulping of Hardwood (Water Oak: *Quercus Nigra*)—Pulping Characteristics, Kinetics and Economics", Thesis submitted to the Graduate Faculty of North Carolina State University, Department of Wood and Paper Science, Raleigh 1979, 152 pages.
Hart et al, "Anthraquinone Pulping of Non–Wood Species", *TAPPI Proceedings*, 1993, pp. 585–593.
Sturgeoff, "Low Kappa Pulping Without Capital Investment—Use of Anthraquinone for Low Kappa Pulping", *TAPPI Proceedings*, 1993, pp. 423–429.
Lindblad et al, "The Effect of Anthraquinone on the Pulp Yield in Modified Kraft Pulping of Birch", paper presented in Stockholm, Jan. 1987, 30 pages.

* cited by examiner

TREATMENT OF CELLULOSE MATERIAL WITH ADDITIVES WHILE PRODUCING CELLULOSE PULP

CROSS-REFERENCE TO RELATED APPLICATIONS

This application is based on provisional applications 60/076,628 filed Mar. 3, 1998, and 60/083,581 filed Apr. 30, 1998.

BACKGROUND AND SUMMARY OF THE INVENTION

The present invention relates to various methods and apparatuses for treating comminuted cellulosic fibrous material during the pulping process with a solution containing additives for improving the efficiency of the pulping process or for improving the quality of the pulp produced. Typical additives include, but are not limited to, polysulfide, sulfur and sulfur-containing compounds (e.g. hydrogen sulfide), surfactants, and anthraquinone and their equivalents and derivatives. In the following discussion it is to be understood that use of the term "anthraquinone" is meant to encompass all anthraquinone-based chemicals, their equivalents and derivatives.

Paper products today are manufactured from cellulose pulps produced by a variety of methods. For example, newsprint is made from a high-yield mechanical process in which the wood is ground to produce a pulp which retains 80% or more of the original constituents of the wood, including the undesirable, color-degrading and strength-diminishing constituents, for example, lignin. Fine papers of high brightness and cleanliness used for writing papers or food containers, for example, are typically made by chemical treatment in which the undesirable non-cellulose constituents of the wood, for example, lignin, are dissolved through chemical action typically under pressure and temperature, to produce a relatively pure form of cellulose fibers from which, for example, fine papers can be made. However, because the cellulose and non-cellulose constituents are not segregated in the wood and are typically intermingled with each other, it is difficult to dissolve the non-cellulose constituents without dissolving some of the cellulose. As a result, in the chemical treatment of wood, though the original wood may typically comprise or consist of 70 to 80% of the desirable cellulose and hemicellulose—(that is, the usable carbohydrates), typically only about 60 to 70% of the usable carbohydrates are retained in the final product. Some of the desirable carbohydrates are dissolved at the same time as the undesirable non-carbohydrate material. The percentage, by weight, of the amount of cellulose (and some non-cellulose) retained, excluding moisture, compared to the amount of wood introduced to the process is referred to as the "yield" of the process. Where mechanical pulping methods may have yields greater than 80%, chemical pulping processes typically have yields of about 50%. Of course, the paper manufacturer desires the highest yield possible.

In addition to yield, another important property of cellulosic pulps is the relative strength of the paper produced from the pulp. Typically, the strength of a paper is a function of two features of the cellulose fibers from which the paper is produced: the intrinsic strength of the fibers and the strength of the bonds between the fibers. The strength of individual fibers is typically characterized as the amount of load that the fiber can withstand while under axial tension and also the amount of load that the fiber can withstand when exposed to a transaxial force, that is, shear. The strength of individual fibers is typically associated with what is termed the "tear strength" of a sample of paper produced from the fiber. The strength of the bonds between fibers is a function of the relative surface area and the flexibility of the fiber, among other things. The strength of these bonds is typically indicated by what is called the "tensile strength" of a sample of paper produced from the fibers. The tear and tensile strength of a paper sample are typically inversely proportional: as the tear strength increases, the tensile strength decreases, and vice versa.

The kraft chemical pulping process (also known as the sulfate process) is typical of a chemical pulp process that produces pulps of high strength and yields of around 50%. In the kraft process the wood is chemically treated under temperature and pressure with an aqueous solution of sodium hydroxide [NaOH] and sodium sulfide [$Na_2S$]. However, it is sometimes possible to incrementally increase the yield of the kraft process by introducing additives or chemical treatments to the process, typically before treatment with the sulfide and hydroxide. Note that a 1% increase in yield for a typical 1000 ton-per-day pulp mill, which sells pulp at approximately $500.00 per ton, can mean over 3 million dollars in added revenue per year, with no increase in wood usage. Thus, single-digit increases in yield can have significant impact upon the profitability of a pulp mill. If a pulp mill is capacity limited due to limitations in increasing the capacity of its recovery boiler, an increase in the yield of a pulping process can increase the capacity of the mill while avoiding the limitations of the recovery system.

As described in Pulping Processes (1965) by Rydholm [pp. 1003–1004] and elsewhere, it is generally understood that cellulose degradation under alkaline conditions is governed by what are referred to as "peeling" reactions and "stopping" reactions. Peeling reactions are the reactions that occur at the ends of cellulose molecules in which individual carbohydrate units, or monomers, are detached or "peeled" from the end of the carbohydrate chain. In this reaction, the aldehydic end groups of the cellulose chains are cleaved from the chain exposing a new aldehydic end group. This newly-exposed end groups can continue to be cleaved until a carboxyl end group is formed and the peeling reaction is terminated. This formation of a carboxyl end group is referred to as the "stopping" reaction. This stopping reaction stabilizes the carbohydrate chain against further degradation by "peeling". As described by Rydholm, typically 50 or more monomers are "peeled" from a newly-exposed end of a carbohydrate chain during alkaline chemical treatment. This degradation of the cellulose molecular chains can be manifest as a reduction in yield (that is, "peeling" causes the dissolution and loss of cellulose).

Conventional mechanisms for increasing the yield of chemical pulping process are directed toward limiting the amount of cellulose lost through alkaline peeling by promoting the stabilization of the end groups against this peeling reaction, that is, they promote the formation of a carboxylic end group.

As explained, for example, in Pulp and Paper Manufacture, Volume 5: Alkaline Pulping", edited by Grace, et al. [pp. 114–122], several recognized additives can be used to stabilize the alkaline peeling reaction and incrementally increase the yield of chemical pulp mills. These include sodium borohydride [$NaBH_4$], sodium polysulfide [$Na_2S_n$] (known simply as "polysulfide"), and anthraquinone (AQ). Smook (1989) in his Handbook of Pulp and Paper Technologists also mentions that hydrogen sulfide [$H_2S$] gas pretreatment of chips can be used to increase yield.

U.S. Pat. No. 4,012,280 discloses that improved yield of an alkaline chemical pulping process can be obtained by adding cyclic keto compounds, including anthraquinone, to the cooking liquor and treating cellulose material with the cooking liquor-AQ solution at pulping temperatures. However, in such a process the AQ additive is not recovered and is simply lost to the pulping process, even though it is known that AQ is a catalyst. U.S. Pat. No. 4,127,439 improved on the earlier AQ treatment process by limiting the exposure of cellulose material to AQ only in a pretreatment stage prior to digestion. In this process, the pretreatment liquor is separated from the cellulose material prior to digestion and the separated pretreatment liquor containing residual AQ is re-used for pretreatment. U.S. Pat. No. 4,127,439 includes the option of pretreating cellulose in a continuous process in which the treatment liquid counter-currently displaces the pretreatment liquor in a single treatment zone. However, the removal and recovery of the pretreatment liquor is limited due to the treatment in one treatment zone.

U.S. Pat. No. 4,310,383 discloses an alternative to the above pretreatment with anthraquinone in which the variation in the solubility of the anthraquinone in an alkaline liquor is used to produce an internal circulation of anthraquinone in a treatment zone. This internal circulation results from the variation in the solubility of anthraquinone which occurs in a counter-current treatment of cellulose. The AQ-containing solution is introduced at one end of a counter-current treatment zone at higher alkalinity where the AQ is more soluble. This high alkalinity is effected by also introducing highly-alkaline kraft white liquor while introducing the AQ to the cellulose. The alkalinity of the counter-current flowing liquid decreases as the alkali is consumed by the cellulose material such that the alkalinity of the AQ solution is reduced to a point where the AQ becomes insoluble and precipitates onto the cellulose. The down-flowing cellulose then carries the precipitated AQ back into the other end of the treatment zone where the alkalinity is higher such that the AQ again dissolves. The dissolved AQ then passes back counter-currently to the flow of cellulose and the cycle repeats itself. Though this process provides for the recovery and re-use of anthraquinone it is not applicable to treatments with other additives, such as polysulfide or sulfur, which are not characterized by such variation in solubility due to alkalinity.

The present invention comprises or consists of a process of producing cellulose pulp from cellulose material with the aid of a strength or yield-enhancing additive in a manner such that the additive is more effectively used and the loss of the additive is minimized. Contrary to the process described in U.S. Pat. No. 4,310,383, the present invention is not dependent upon alkalinity and its effect upon the solubility and precipitation of the additive. The present invention is based upon the natural mass transfer of chemical additives from solution to the carbohydrates, the effect of liquid flows on this mass transfer, and the efficient recovery and reuse of the additives. This process is particularly amenable for use with the process and equipment described in the following U.S. Pat. Nos. 5,489,363; 5,536,366; 5,547,012; 5,575,890; 5,620,562; 5,662,775 and others, and sold by Ahlstrom Machinery, Glens Falls, N.Y., under the trademark LO-SOLIDS®. That is, the present invention is most amenable to conditions under which the concentration of dissolved organic material in the treatment liquor is minimized, as is characteristic of the Lo-Solids® processes available from Ahlstrom Machinery Inc. of Glens Falls, N.Y.

The process and equipment of the present invention, marketed by Ahlstrom Machinery under the trademark LO-SOLIDS®-M2™, utilizes the flexibility of a LO-SOLIDS® configuration in order to enhance the effectiveness of additives such as anthraquinone, polysulfide, sulfur and sulfur-containing compounds, surfactants, or any combination thereof. It is designed to maximize additive concentrations and retention times. It is also designed to optimize the additive concentration profile with respect to the alkali concentration, dissolved organic material concentration, and temperature profiles of the cook.

First, consider factors which influence the effectiveness of chemical additives in the pulping process, for example, anthraquinone. During kraft pulping, anthraquinone will oxidize the reducing-end groups of polysaccharides into alkali stable carboxylic acids. This stabilization arrests alkali-peeling reactions and thus results in increased polysaccharide yield. The reduced form of anthraquinone then reacts with lignin. Reactions with lignin render the lignin more prone to degradation and dissolution, and also serve to re-generate the oxidized form of the anthraquinone. Thus, anthraquinone is a catalyst which performs two useful functions in kraft cooking: (i) it stabilizes polysaccharides thus enhancing yield, and (ii) it accelerates delignification.

A true catalyst is not consumed during a reaction and so its effectiveness will depend primarily on "activity" (or concentration) within the reaction mixture. The concentration of anthraquinone will depend on: (i) the amount of anthraquinone added to the system, and (ii) the hydraulic liquid-to-wood (L:W) ratio in the system. For a continuous digester, the L:W ratio varies from zone to zone. For a LO-SOLIDS® operation, the L:W varies more than for a conventional system and it can be independently controlled from zone to zone.

Unfortunately, all of the prior art literature on AQ is reported on a %-applied-on-wood basis and does not, therefore, take into account hydraulic and concentration effects. The prior art entirely comprises results for conditions which are typical of a batch lab or a batch full scale process: specifically, for conditions where the L:W ratio is greater than 3.5:1 (typically 4:1 or more). For a conventional continuous digester, however, the L:W ratio in the impregnation zone will be somewhere between 2.5 and 3.5 to 1. Thus, the concentration and effectiveness of anthraquinone or other additives will be as much as 35% greater in a conventional continuous process than the literature would suggest.

For modified cooking processes such as LO-SOLIDS® pulping, a large portion of the white liquor is shifted away from the feed and introduced, instead, straight into the digester. This means the initial L:W ratio in the impregnation zone will be less than the initial L:W ratio of conventional, non-modified systems. As a result, the concentration of additives, such as anthraquinone, will be greater in a modified system, if the % applied to the feed remains constant.

One hindrance to the understanding of the effect of chemical additive concentration on the effectiveness of the treatment is the conventional nomenclature used to describe the amount of liquid present in a cooking process. As discussed above, the expression "liquid-to-wood ratio" or "liquor-to-wood ratio" is commonly used in the art to indicate how much liquid is present relative to the amount of wood or cellulose. In batch processes, in which wood and liquids are introduced in discreet amounts and are retained in an enclosed vessel, these ratios provide somewhat useful information. However, in continuous processes, especially in modified continuous processes in which liquids may flow independently of the wood material, the amount of liquid and wood present in a region of the digester is not as well defined. For example, a slurry of chips and liquid flowing through a continuous treatment vessel contains some liquid that is trapped within the pores of the chips, that is, the so-called "bound" liquid, and some liquid which is "free" to flow about the chip. Though the amount of "bound" liquid may remain relatively constant, the volume of "free" liquid may vary depending on the flow direction and flow rate of the liquid in the digester. Furthermore, the amount of "wood" present during different stages of a continuous cooking process varies as the pulping process progresses. More wood is present earlier in the process than in the later stages of the process. Thus, defining a quantity "per wood" is also somewhat ambiguous.

Thus, unlike the batch process, a "liquor-to-wood" ratio for a continuous pulping process may be misleading, or at least not completely representative of the conditions that are present in a continuous digester, especially a digester in which the concentration of chemical additives in the liquid is under consideration.

In order to better define the conditions that exist within a continuous digester and to better understand the significance of the present invention, the following terms have been coined, and are defined as follows: the Net Liquid Flow Rate (NLFR) and the Net Additive Concentration (NAC). The NLFR is the vector sum of the volumetric flow rates of the bound liquor, $F_B$, plus the volumetric flow rate of the free liquor, $F_F$, using the convention that the direction of the bound liquid flow is positive. That is, a treatment region having a co-current flow of treatment liquid will have an NLFR given by:

$$NLFR=F_B+F_F \tag{1}$$

while a region having a counter-current flow of treatment liquid will have an NLFR given by:

$$NLFR=F_B-F_F \tag{2}$$

An NLFR may be expressed in any preferred volumetric flow dimensions, for example, gallons per minute (gpm) or liters per minute (lpm), but NLFR is preferably expressed in units of "tons of liquid per ton of wood fed to the system", or T/T. As indicated by equation (2), an NLFR may be positive or negative. In the present invention, the NLFR may range from −2 to 6 TIT, but is preferably between −1 and 3 T/T, and may vary between different treatment zones. The NLFR provides a more useful parameter for characterizing the liquid flow rates through a treatment zone of a continuous digester than the more conventional liquor-to-wood ratio.

The Net Additive Concentration (NAC) of a chemical additive is simply the specific concentration of the additive chemical present in the liquor flowing through a treatment zone, that is, the additive concentration present in the NLFR. This concentration is determined by dividing the mass flow rate of the additive introduced into the treatment zone by the NLFR present in the treatment zone, that is, $$NAC=[\text{Grams/minute of additive}]/NLFR \tag{3}$$

Thus, NAC can typically be expressed as pounds per gallon or grams per liter of additive present in the treatment zone. In a preferred method, the additive flow is expressed in "tons of additive per ton of wood fed to the system", such that a equation (3) yields the dimension "tons of additive present in a treatment zone per ton of liquid present". Note that if NLFR is negative, that is, the treatment zone is a counter-current treatment zone, the absolute value of NLFR can be used.

As an example, the typical conventional amount of AQ charged to a system is about 0.1% maximum, or 0.001 tons of additive per ton of wood fed to the system (T/T). Due to deactivation, consumption, and other factors, in prior art systems, this charge typically produces AQ concentrations in the treatment liquor of approximately 0.00075 T/T, typically less than 0.0010 T/T. However, the NAC present in the treatment zone of the present invention can exceed 0.0015 T/T and even exceed 0.0020 T/T, while not increasing the 0.1% charge of AQ. The value of NAC will vary for other additives. For example, since the maximum charge of polysulfide is about 1% on wood, or 0.01 T/T, the NAC for polysulfide for the present invention is expected to be about 10 times that of AQ.

The NAC calculated by equation (3) is the average concentration of the additive in the treatment zone. The actual local concentrations will vary due to the variation in the flow through the zone and additive concentration gradients, due to decomposition and deactivation, within the zone. The present invention maximizes the NAC in a treatment zone of a continuous digester by minimizing the NLFR in the treatment zone.

It is known that the presence of dissolved organic material (for example, dissolved lignin, dissolved cellulose, and dissolved hemicellulose, among other dissolved wood materials) interferes with the effectiveness of additives. For example, dissolved lignin deactivates anthraquinone such that it is less effective in preserving yield during a pulping process. Another feature of the present invention is that the concentration of additive present during treatment is increased while concentration of dissolved organic material, which can interfere with the beneficial effects of the additive, is minimized during treatment with an additive such that the effectiveness of the treatment is optimized.

One method of expressing this optimized condition is by use of the ratio of the concentration of additive, [A], to the concentration of dissolved organic material, [DOM]. This ratio, referred to as the "M2 Ratio", is given by:

$$M2\ \text{Ratio}=[A]/[DOM] \tag{4}$$

where the concentration of the additive, A, is expressed in milligrams per liter (mg/l) and the concentration of DOM is given as grams per liter (g/l). For example, at a point in the treatment where the average anthraquinone concentration is 200 mg/l and the average DOM concentration is 100 g/l the M2 ratio is 2.0 mg/g. Specifically, this is referred to as the "M2-AQ ratio", since the additive is anthraquinone. In the prior art, using a maximum AQ charge of 0.1%, the concentration of AQ in the treatment liquid, due to deactivation and consumption, is typically less than 300 mg/l and the concentration of dissolved organic material in the same treatment liquor is typically 100 g/l or more. Thus, in prior art treatments with AQ the ratio of the concentration of the AQ to the concentration of the DOM is typically less than 3.0 mg/g. Typical values for the M2-AQ Ratio according to the present invention, for an AQ charge of 0.1%, are at least 4.0 mg/g, preferably, at least about 5.0 mg/g, most preferably, at least about 6.0 mg/g, and sometimes over 8.0 mg/g.

Other ratios are defined for other additives, such as the "M2-PS ratio" for use when polysulfide is the additive, or the "M2-Surf Ratio" when surfactants are used. For example, since the typical charge of polysulfide is about 10 times that of anthraquinone, the value of the M2-PS Ratio is expected to be about 10 times that of M2-AQ, or at least about 40.0 mg/g, preferably, at least about 50.0 mg/g, most preferably, at least about 60.0 mg/g. [Thus an M2-AQ Ratio of 5.0 mg/g is equivalent to an M2-PS Ratio of about 50.0 mg/g.]

According to the present invention, it is desirable to have the highest practical additive concentration while having the smallest DOM concentration. Thus, according to the present invention, the highest M2 ratio possible is preferred.

Typically, additives such as polysulfide, anthraquinone, and the like, are removed from the cooking vessels with the liquors through one or more conventional annular screen assemblies. This liquid containing valuable additives is typically either recirculated back to the cooking vessel via a circulation or forwarded to the chemical and heat recovery system of the pulp mill. In either case, the valuable additive may be lost from the process and therefore must be replenished with a fresh supply of additive if treatment is to continue. The present invention also includes the method of recovering at least some of the additive in the liquor removed from the digester by passing the additive-bearing liquid through one or more filtration devices, preferably an ultra-filtration device. This may require that the liquid stream be cooled prior to introducing it to the filtration device, for example, by conventional evaporation or flash evaporation or passing the liquor through a heat exchanger. The additive separated from the liquor can be reintroduced in the process as needed, for example, as a supplement to the fresh additive that is introduced. Anthraquinone is one additive that can be recovered and re-used in this manner.

In its simplest form, the process of the present invention comprises or consists of the following: (a) treating (e.g. pretreating) the cellulose material with a solution containing a yield or strength-enhancing additive; (b) displacing the majority, preferably the vast majority (typically over about 90%), of any of the additive from the cellulose material prior to bulk delignification in a counter-current treatment zone so that the content of the additive in the material slurry is minimized; and (c) treating the material with an alkaline cooking liquor to produce a cellulose pulp. Preferably (a) is performed in a counter-current fashion. The additive used in (a) is preferably anthraquinone or its equivalents or derivatives (collectively "AQ"), but other additives such as polysulfide, hydrogen sulfide, a surfactant (for example, a surfactant can be used with anthraquinone to enhance the solubility of the anthraquinone), sulfur or sulfur-containing compounds, or others, or combinations thereof, or combinations thereof in the presence of a cooking liquor, such as kraft white, green or black liquor, may be utilized.

Preferably (a) is performed at a temperature and alkalinity at which little or no additive is consumed and is thus available for recovery at (b) and can be re-used. The temperature of treatment (a) is preferably below cooking temperature, typically below 140° C., for example, between about 120 and 140° C., preferably between about 125° and 140° C. The temperature during (b) is typically between about 130–150° C., preferably, between 130 and 145° C. The NLFR during (a) is typically between −2.0 and 2.0 T/T, preferably, between about −1.0 and 1.0 T/T, most preferably, between about −0.5 to 0.5 T/T, or as close to 0 as practical. The NLFR during (b) is typically between −3.0 to 1.0 T/T, preferably, between about −3.0 to 0 T/T, most preferably between about −2.0 and −1.0 T/T.

Since the principal treatment with additive occurs during (a) it is desirable to establish the highest possible Net Additive Concentration (NAC) during (a). According to the present invention the NAC during (a) is at least 0.0010 T/T, preferably at least about 0.0015 T/T, most preferably at least about 0.0020 T/T. Since during (b) the additive is being displaced it is preferable to have the least additive possible present during (b). Also, the M2 Ratio during (a) is also preferably as high as possible. For example, the M2-AQ Ratio during (a) is typically at least 4.0 mg/g, preferably, at least about 5.0 mg/g, most preferably, at least about 6.0 mg/g. The M2-PS Ratio during (a) is typically at least about 40.0 mg/g, preferably, at least about 50.0 mg/g, most preferably, at least about 60.0 mg/g. Again, the M2 Ratios during (b) are preferably as small as possible since the additive is being displaced.

The alkali concentration, or effective alkali, in (a) typically ranges from 3 to 14 g/l expressed as NaOH, for example, the alkali concentration at the beginning of (a) may be about 3 to 6 g/l as NaOH and the alkali concentration at the end of (a) may be about 10 to 14 g/l as NaOH. The alkali concentration in (b) typically ranges from about 6 to 18 g/l as NaOH, for example, the alkali concentration at the beginning of (b) may be about 6 to 8 g/l as NaOH and the alkali concentration at the end of (b) may be about 14 to 18 g/l as NaOH.

Preferably (c) comprises or consists of a co-current or counter-current cooking process, for example, the LO-SOLIDS® cooking process described in the above-referenced U.S. patents. The alkaline cooking liquor of (c) is typically kraft white liquor, green liquor, or black liquor, or soda cooking liquor, or a polysulfide containing liquor, or some combination thereof. Preferably (c) is performed at a temperature of at least 140° C., typically, between about 140 and 160° C. and at an effective alkali concentration of greater than 15 g/l, expressed as NaOH, typically, between about 17 to 23 g/l expressed as NaOH; and (a)–(c) are preferably practiced so as to provide a yield of at least 3% (e.g. at least 4 or 5%) higher than the yield produced by methods not employing (a) and (b).

In a preferred embodiment of the present invention, (a) is preceded by (d) pretreating the cellulose material with an alkaline liquid, with or without the presence of an additive. Preferably (d) is a co-current treatment, though it may also be counter-current treatment, and is performed at a temperature less than 130° C., preferably less than 120° C., for example, between about 100 and 110° C., for example, (d) may be an impregnation or a cool impregnation. Furthermore, (d) is preferably followed by (e) removing at least some of the free liquor from the slurry prior to (a). Preferably (e) is a post-impregnation extraction which removes the dissolved organic material produced during (d) such that the concentration of dissolved organic material is minimized prior to (a). Some of the liquid removed during (e) may contain useful additive; this liquid may be re-introduced to the cellulose material prior to or during (d).

In another embodiment, a further step (f), prior to (c), is performed in which at least some of the liquid in the material slurry is removed from the slurry after (a). This liquid, which typically contains at least some additive, may be re-introduced to the slurry prior to or during (d). Also, (f) may be performed after (b) and the liquor removed re-introduced prior to or during (d).

According to another aspect of the invention a method of continuously producing chemical cellulose pulp from comminuted cellulosic fibrous material slurry, with a yield or strength increase, is provided comprising: (a) Treating (e.g. pretreating) the comminuted cellulosic fibrous material slurry with a solution containing yield or strength-enhancing additive. (b) Displacing liquor containing at least some of the additive from (a) in a continuous counter-current treatment zone. (c) Recirculating liquor containing displaced additive from (b) to the slurry in (a). And, (d) treating the material with an alkaline cooking liquor, at cooking temperature, to produce a cellulose pulp with higher yield or strength than if (a) and (b) were not practiced.

In the method (a) is practiced using AQ, PS, $NaBH_4$, sulfur or sulfur-containing compounds, a surfactant, combinations thereof, or combinations thereof with other chemicals. Also preferably in the method (a) is practiced using AQ, or a combination of AQ and other chemicals; and (a) is practiced at a temperature below about 140° C., for example, between about 120 and 140° C., preferably between about 125° and 140° C., and (b) is practiced at a temperature of between about 130–150° C., preferably, between about 130 and 145° C. The NLFR during (a) is typically between −2.0 and 2.0 T/T, preferably, between about −1.0 and 1.0 T/T, most preferably, between about −0.5 to 0.5 T/T, or as close to 0 as possible. The NLFR during (b) is typically between −3.0 to 1.0 T/T, preferably, between about −3.0 to 0 T/T, most preferably, about −2.0 and −1.0 T/T. The NAC and M2 ratios during (a) and (b) are typically as discussed previously.

The alkali concentration, or effective alkali, in (a) typically ranges from about 3 to 14 g/l expressed as NaOH, for example, the alkali concentration at the beginning of (a) may be about 3 to 6 g/l as NaOH and the alkali concentration at the end of (a) may be about 10 to 14 g/l as NaOH. The alkali concentration in (b) typically ranges from about 6 to 18 g/l as NaOH, for example, the alkali concentration at the beginning of (b) may be about 6 to 8 g/l as NaOH and the alkali concentration at the end of (b) may be about 14 to 18 g/l as NaOH.

According to another aspect of the invention a continuous digester system is provided comprising: A substantially vertical digester vessel having a top and a bottom. An inlet for comminuted cellulosic material liquid slurry, adjacent the vessel top. An inlet for yield or strength-enhancing additive in the upper half of the vessel. An outlet for chemical pulp adjacent the vessel bottom. A liquor/material separator adjacent the inlet for separating some liquid from the slurry introduced through the inlet. A first set of screens at a first vertical level in the digester, below the separator. A second set of screens at a second vertical level in the digester below the first set. A third set of screens at a third vertical level in the digester, below the second set. Means for recirculating liquor containing displaced yield or strength containing additives from the first set of screens to the slurry above the first set of screens. Means, including the first set of screens, for establishing a counter-current, upward, flow of liquid substantially between the first and second set of screens in a first zone. And, means for introducing yield or strength-enhancing additive into the vessel adjacent the second set of screens to flow upwardly with liquid in the first zone.

The digester system preferably also is constructed so that the first set of screens comprises a top screen and a bottom screen; and wherein the reintroducing means comprises the bottom screen and a conduit leading from the bottom screen to the slurry before or after the inlet; and wherein a conduit from the top screen is connected to a flash tank. Also the system preferably further comprises means, including the second set of screens, for providing a counter-current flow of liquor to slurry in a second zone, between the second and third set of screens. Also, preferably the third set of screens comprises a top third screen and a bottom third screen; and the system further comprises a conduit from the bottom third screen connected to a flash tank, and a conduit from the top third screen returning liquor to the interior of the vessel adjacent the third set of screens.

The relationship of the recirculation conduit outlets to the screen assemblies in the present invention are also preferably as disclosed in U.S. Pat. No. 5,849,151, the disclosure of which is incorporated in its entirety in this specification.

It is the primary object of the present invention to produce chemical cellulose pulp (e.g. kraft pulp) with enhanced yield and/or strength in a relatively cost effective manner since yield and/or strength enhancing additives are almost completely effectively use, rather than being destroyed as in the prior art. This and other objects of the invention will become clear from the detailed description of the invention and the appended claims.

DETAILED DESCRIPTION OF THE DRAWINGS

Figure 1:
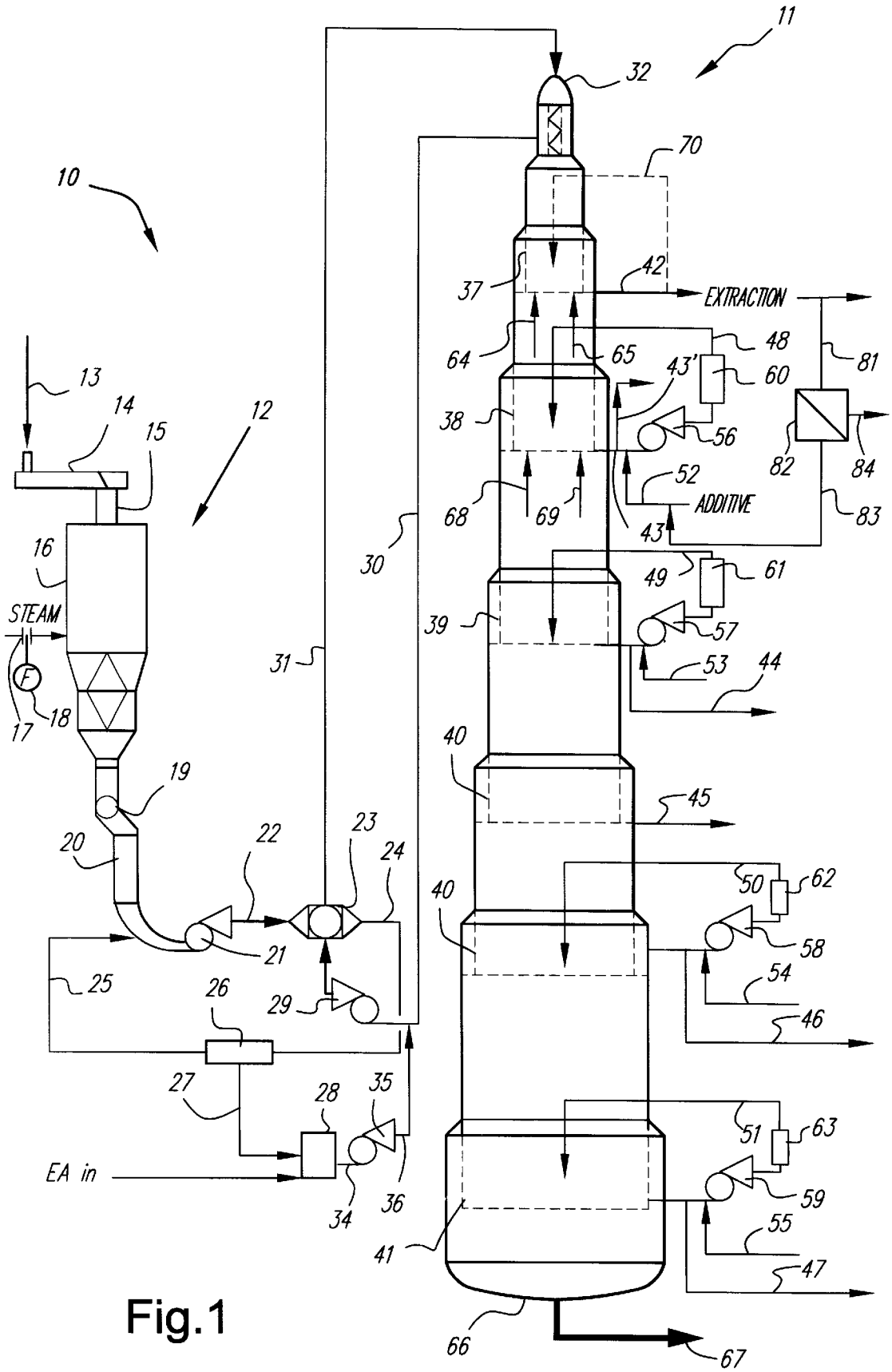
FIG. 1 is a schematic side view of one embodiment of an exemplary digester system according to the present invention for practicing a method according to the invention.

FIG. 1 illustrates a system 10 for carrying out the process of the present invention, comprising or consisting of a continuous digester 11 fed by a feed system 12. Comminuted cellulosic fibrous material 13 is introduced to the inlet of a conventional isolation device 14 in which the feed system is isolated from the ambient environment. Though any form of comminuted cellulosic fibrous material may be treated according to this invention, wood chips are preferred. The following discussion will use the term "chips" to represent any comminuted cellulosic fibrous material.

The feed system 12 may comprise or consist of any conventional feed system, but the preferred feed system is a LO-LEVEL® feed system as sold by Ahlstrom Machinery of Glens Falls, N.Y. This feed system is described in U.S. Pat. Nos. 5,476,572; 5,622,598; and 5,635,025. The LO-LEVEL® feed system is particularly suited for pretreatment according to the present invention since this system allows for the feeding and treatment of chips at lower temperatures than can be handled by conventional feed systems.

Any appropriate isolation device may be used for device 14, such as a star-type feeder or screw feeder, but the preferred device shown in FIG. 1 is a horizontal screw feeder having a hinged door adjacent its outlet as described in U.S. Pat. No. 5,766,416 and sold by Ahlstrom Machinery. The pre-loaded hinged door at the outlet of this feeder creates an effective seal between the chips being transferred by the feeder and the feeder housing such that little or no gases escape during the introduction of chips to the feed system.

The isolation device 14 discharges via conduit 15 to the inlet of the vessel 16 in which the chips are exposed to steam 17. Again, any suitable vessel may be used to introduce steam to the chips but one preferred vessel is one sold by Ahlstrom Machinery under the trademark DIAMOND-BACK® steaming vessel. This vessel is described in U.S. Pat. Nos. 5,500,083; 5,617,975; and 5,628,873. Steam 17 may be introduced at one or more elevations or locations about the circumference of vessel 16. The flow of steam to vessel 16 is regulated by a flow control valve and flow controller 18. The steamed chips are discharged by gravity, preferably without the aid of mechanical agitation, as is characteristic of discharge from a DIAMONDBACK steaming vessel, to a metering device 19.

Metering device 19 may be any suitable metering device for regulating the flow of steamed chips from vessel 16, such as a star-type or screw-type metering device. In FIG. 1, the preferred metering device is a star-type metering device sold under the name Chip Meter by Ahlstrom Machinery. Metering device 19 regulates the flow of steamed chips into conduit 20 which feeds the chips to the inlet of slurry pump 21. Conduit 20 is preferably a Chip Tube sold by Ahlstrom Machinery. Slurry pump 21 is preferably a helical screw type pump, for example, a Hydrostal pump as sold by the Wemco Company of Salt Lake City, Utah, though other types of pumps may be used. Conduit 20 typically contains a cooking liquor such that a level of liquor is provided below the inlet of conduit 20, though the level of liquid may extend up to and into the bottom of vessel 16. The cooking liquor may be kraft white liquor, black liquor or green liquor containing one or more pulp yield or strength enhancing additives.

Slurry pump 21 discharges a slurry of chips and liquor to high pressure feeding device 23 via conduit 22. Device 23 is typically a High Pressure Feeder sold by Ahlstrom Machinery, but any other form of conventional device for this purpose may be used. For example, the dual pumping system disclosed in U.S. Pat. No. 5,753,075 may also be used in place of pump 21 and feeder 23. Feeder 23 typically contains a screen which retains the chips in the slurry introduced via conduit 22 but permits the passage of liquid into conduit 24. Under the pressure supplied by pump 21, the liquor in conduit 24 is recirculated back to tube 20 via conduit 25 to supply the level of liquor present in tube 20. The liquor in conduit 24 is typically passed through a liquor and chip separating device 26, such as an In-line Drainer, sold by Ahlstrom Machinery, in which excess liquor is removed from conduits 24 and passed to storage tank 28 via a conduit 27. Tank 28 is preferably a Level Tank available from Ahlstrom Machinery.

The chips retained in feeder 23 are propelled to the top of vessel 11 in conduit 31 via a high pressure liquor provided by pump 29 from conduit 30. The liquor and chip slurry in conduit 31 is introduced to a separating device 32 in which some of the slurry liquor is removed and returned to the feed system 12 via conduit 30 to supply the liquor for pump 29. The supply of liquor to pump 29 may be augmented by liquor stored in tank 28 and supplied by conduit 34, pump 35, and conduit 36 to conduit 30. The separating device 32 is preferably a Top Separator as sold by Ahlstrom Machinery, but it may also be an Inverted Top Separator as also sold by Ahlstrom Machinery. The chips retained in the separator 32 are introduced to the top of digester 11. Digester 11 may be a hydraulic digester having no gas space at the top, or a vapor or steam phase digester having a gas zone above the liquor at top. One preferred type of digester is one having a gas zone above a submerged chip pile as disclosed in application Ser. No. 08/797,327 filed on Feb. 10, 1997 now U.S. Pat. No. 5,882,477 . The essentially fully-treated chips are discharged from the outlet 66 as pulp in conduit 67, and the pulp is transferred to further (e.g. conventional) treatment, such as brownstock washing and/or bleaching.

Digester 11 is equipped with several annular liquor withdrawal screens 37, 38, 39, 40, and 41. These screens typically comprise or consist of perforated plate or parallel bars which retain the cellulose material within vessel 11 while liquor is removed. The liquor removed via the screens 37–41 may be passed to other treatment, for example, to a Heat and Chemical Recovery system, as shown by conduits 42, 43', 44, 45, 46, and 47, or the removed liquor may be recirculated back to the general vicinity from which it was removed, as shown by conduits 70, 48, 49, 50, and 51. The liquor recirculated in lines 48–51 may be augmented with other liquors via conduits 52, 53, 54, 55, such as kraft cooking liquors, including white, green and black liquor; low dissolved organic material-containing dilution liquor (e.g. filtrate or fresh water); or liquor containing beneficial additives as described above. The recirculated liquors are typically pressurized by pumps 56, 57, 58, and 59 and heated by conventional indirect steam heat exchangers 60, 61, 62, and 63.

In the preferred embodiment of the invention, liquor is removed from the slurry by screen 37 and conduit 42 so that a counter-current upflow of liquor is provided between screens 37 and 38. This counter-current flow is shown schematically by arrows 64 and 65. The liquor in conduit 42 may be recirculated in circulation 70 (shown in phantom) by using a conventional pump and heater as illustrated in the other circulations (e.g. 48, 56, 60). According to the present invention, an additive is added to the counter-current treatment zone indicated by arrows 64, 65 via circulation 48. For example, the additive may be introduced via conduit 52 upstream of pump 56. This additive can be any suitable beneficial additive, but is preferably an additive that can increase the strength or yield of the final product. Typical desirable additives include, anthraquinone, and its equivalents and derivatives; sulfur and its derivatives and equivalents, such as polysulfide or hydrosulfide; and/or a surfactant; etc., as described above. These additives may be used alone or combined, and/or used with an appropriate addition of alkali, for example, in the form of sodium hydroxide, or kraft white, green or black liquor. The additive may comprise or consist of any reducing agent that produces beneficial results in the pulp produced, for example, increased strength or yield (each by at least 1%, preferably at least 2%, and more preferably at least about 4%), compared to conventional methods. Though heat may be added to circulation 48 via heater 60 it is preferred that the temperature of the liquor introduced by circulation 48 be limited to prevent the degradation or deactivation of the additive or premature degradation of the cellulose. The temperature of the slurry between screens 37 and 38 is preferably not more than about 140° C., typically between about 120 and 140° C. (or any narrower range therebetween, e.g. between about 120–130° C.).

After counter-current treatment 64, 65, with an additive, liquor is removed from the digester 11 at screen 38. The liquor removed via screen 38 may be removed by conduit 43' for use or treatment elsewhere, or it may be recirculated via circulation 48 with the addition of additive via conduit 52. The liquor removed from screen 37 by conduit 42 and/or screen 38 by conduit 43' (from recirculation conduit 43) is preferably sufficient to produce a counter-current flow of liquor between screens 38 and 39, as shown schematically by arrows 68 and 69. According to the present invention, the counter-current flow 68, 69 provides the additional displacement of the additive from the slurry so that little or no additive is passed to and lost to the pulping process at or below screen 39. Preferably almost all the additive introduced to the digester is displaced in liquor flows 64, 65, 68, 69 and removed from the vessel via conduits 42 and 43. The additive contained in the liquors in conduits 42 and 43 may also be re-used, for example, by introducing it to circulation 70, or to the circulation associated with conduit 30 (that is, the "top circulation" of a single-vessel digester or the "bottom circulation" of a two-vessel digester); or the additive containing liquor may be re-introduced as desired to the feed system 12, for example to conduit 20, vessel 16, or the circulation defined by conduits 24 and 25.

The liquor removed via conduit 42, which may typically contain at least some additive, may also be passed via conduit 81 through a conventional filtration device 82. In filtration device 82, at least some of the additive, e.g., anthraquinone, is isolated from the liquor and can be re-used via conduit 83. For example, the anthraquinone-bearing liquid can be reintrodcued to conduit 52 via conduit 83. The anthraquinone-depleted stream 84 can be passed to chemical recovery or other uses. Device 82 is preferably a conventional ultrafiltration device, preferably one that can operate at temperatures exceeding 100° C. If desired, the liquor in conduit 81 can be cooled via a heat exchanger, flashing, or evaporation prior to being introduced to the filter device 82.

In addition, the volume of liquor removed via conduits 42, 43, and 44, as well as conduit 30, can be regulated to ensure that an optimum Net Liquor Flow Rate (NLFR), as described above, exists during the treatment with an additive. For instance, the NLFR may be decreased in the treatment zones 64, 65, 68, 69—compared to conventional treatments—so that the concentration of the additive in solution, for example the Net Additive Concentration (NAC), as described above, will be increased and thus more effectively contact the cellulose material. Though this invention is conducive to a broad range of NLFRs during treatment, the preferable NLFR during treatment with the additive between screens 37 and 38 is typically between about −2.0 and 2.0 T/T, preferably, between about −1.0 and 1.0 T/T, most preferably, between about −0.5 to 0.5 T/T, that is, as close to 0 as practical. The NLFR during treatment between screens 38 and 39 is typically between about −3.0 to 1.0 T/T, preferably, between about −3.0 to 0 T/T, most preferably between about −2.0 and −1.0 T/T; that is, there is a net upflow of liquor for displacing the additive.

The NAC of the additive between screens 37 and 38, as described above, is preferably at least about 0.0010 T/T, preferably at least about 0.0015 T/T, most preferably at least about 0.0020 T/T. The M2 ratio between screens 37 and 38 is preferably as high as possible. For example, the M2-AQ ratio is typically at least 4.0 mg/g, preferably, at least about 5.0 mg/g, most preferably, at least about 6.0 mg/g. The M2-PS ratio between screens 37 and 38 is typically at least about 40.0 mg/g, preferably, at least about 50.0 mg/g, most preferably, at least about 60.0 mg/g. Since the additive is being displaced between screens 38 and 39 it is preferable to have the least additive possible present between these screens 38, 39. Thus, the NAC and M2 ratios between screens 38, 39 are preferably as small as possible.

The alkali concentration, or effective alkali, between screens 37 and 38 typically ranges from about 3 to 14 g/l expressed as NaOH, for example, the alkali concentration at or below screen 37 may be about 3 to 6 g/l as NaOH and the alkali concentration at or above screen 38 may be about 10 to 14 g/l as NaOH. The alkali concentration between screens 38 and 39 typically ranges from about 6 to 18 g/l as NaOH, for example, the alkali concentration at or below screen 38 may be about 6 to 8 g/l as NaOH and the alkali concentration at or above screen 39 may be about 14 to 18 g/l as NaOH.

After counter-current treatment 64, 65, 68, and 69, the liquor reintroduced via circulation 49 to the vicinity of screen 39 is sufficiently hot enough to commence the pulping reaction in the vicinity of screen 39. That is, the temperature of the slurry in the vicinity of screen 39 is raised to between 140 and 190° C., preferably about 140 to 160° C. Any appropriate pulping process may be used following the pretreatment according to the invention. One preferred process is one which minimizes the dissolved organic material content of the pulping liquor, that is, the LO-SOLIDS® pulping process as described in the U.S. patents listed above. However, regardless of the pulping process performed, since most of the temperature sensitive additive has been displaced from the slurry prior to the slurry reaching pulping temperatures, according to the invention, little or no additive is thermally decomposed or deactivated during the pulping process.

Figure 2:
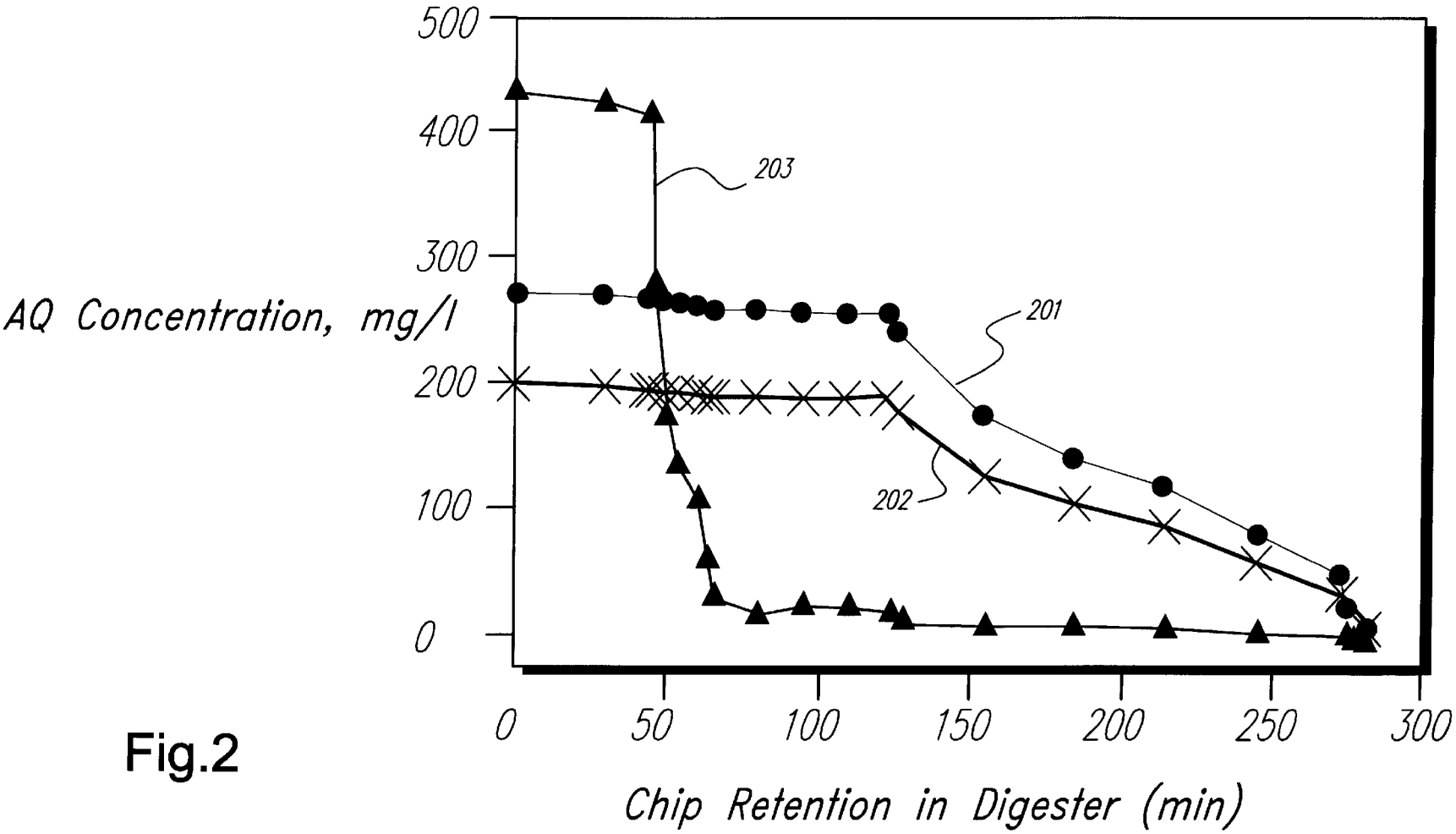
FIG. 2 is a graph showing the projected relationship between AQ concentration and digester retention time when practicing the invention using the system of FIG. 1, compared to conventional kraft processes.

In FIG. 2 a predictive model that has been used to estimate the effect of different process conditions on the AQ time-concentration profile within a digester 11. Note that this model does not take into account adsorption of AQ onto chips, AQ consumption, degradation, or de-activation by combination with other chemicals in the cooking reaction mixture. In other words, the model simply predicts AQ concentration (i.e., what the concentration would be if AQ behaved as an ideal catalyst and was neither consumed, destroyed, nor de-activated). At present, there is incomplete knowledge of these potentially important phenomena and so it is not possible to account for them in the model predictions. While the predictions are incomplete, they are still useful for comparative purposes. The predicted profiles are based upon process simulation assuming steady-state; for all cases, the AQ charge was assumed to be 0.1% on wood with all AQ charged to the feed.

FIG. 2 shows that for conventional continuous cooking under typical conditions, the AQ concentration 201 is on the order of 300 mg/l throughout both the impregnation and bulk delignification zones (64, 65 and thereabove, and 68, 69 and below, respectively, in the FIG. 1 embodiment). The counter-current zone (68, 69) in the digester 11 washes the AQ out of the pulp reaction slurry. Operating at a 4:1 liquid-to-wood ratio, 202, (which is typical of the conditions for either a lab or full-scale batch process) results in more than a 30% decrease in AQ concentration throughout the entire vessel. (Note that the units of the y-axis of FIG. 2 can be converted to tons of additive per ton of pulp fed to the system (T/T) by multiplying the units shown by $3\times10^{-6}$.)

Comparing the profile of process performed according to the methods of the LO-SOLIDS-M2 process, 203, to conventional cooking (with all AQ charged to the feed in both cases), the AQ concentration during impregnation increases by approximately 40% but subsequently decreases due to the post impregnation extraction and dissolved material removal associated with the LO-SOLIDS process. Thus the profile is markedly different for the LO-SOLIDS-M2 process conditions than for conventional cooking: specifically, higher concentrations in impregnation but lower thereafter. There is insufficient knowledge about factors influencing AQ effectiveness to make a sound conclusion whether this results in better utilization of AQ, but circumstantial evidence from 5 mills operating with both the LO-SOLIDS process and AQ suggests that there is a net improvement in AQ effectiveness. These observations suggest that a higher concentration in impregnation (64, 65 and thereabove in FIG. 1) is more important than having AQ in the bulk delignification stage (68, 69 and below in FIG. 1).

However, the observation that the presence of AQ is more effective in impregnation than in bulk delignification is consistent with knowledge of kraft pulping reaction chemistry. It is commonly known that AQ does not behave as an ideal catalyst: a large amount of AQ which is charged to the system "disappears" either as a result of degradation, consumption, de-activation by combination with other chemicals, or some combination of all three of these phenomena. Early lab work by others, as well as some very recent full scale testing, shows that as much as 80% of all AQ charged is no longer present in an active state by the time bulk delignification commences.

It is commonly believed that the principal mechanism for the disappearance of AQ is de-activation via combination with dissolved organic wood material, e.g., dissolved lignin, dissolved cellulose, etc. This helps to explain why higher concentrations in impregnation are more important than having AQ present during bulk delignification: once bulk delignification has started the concentration of dissolved organics, including lignin, is relatively high and AQ is rendered ineffective. Furthermore, in order to be truly effective for end-group stabilization, the AQ must be present and available to react with these end groups before they dissolve, since peeling is irreversible. Finally, the higher temperatures associated with bulk delignification favor the reactions of hydroxide ions with lignin and polysaccharide over the competitive, parallel reactions of AQ with lignin and polysaccharides.

In summary, the effectiveness of the treatment of cellulose material with AQ during kraft cooking is optimal when: (i) temperature is low, (ii) AQ is present before the rise to cooking temperature and commencement of bulk delignification, (iii) concentration of dissolved organic material is low, and (iv) the concentration and retention time of AQ is high. The concentration and retention time of AQ will depend or application rates and system hydraulics: these factors can be controlled with the exemplary apparatus and process of the present invention shown in FIG. 3.

As noted above, the present invention also improves the effectiveness of treating cellulose material with polysulfide (PS). Unlike AQ, PS is a reactant which is consumed during kraft cooking. Thus the percent of polysulfide applied is of greater significance here than for the case of a regenerated catalyst, such as anthraquinone, since its effectiveness will depend more on the quantity of material available than on its concentration. In spite of this, concentration effects will still have a significant role in determining the effectiveness of PS.

As its name implies, PS is a high polymer and so its diffusion into the chip and fiber wall is much slower than that of other chemical reagents such as hydroxide and hydrosulfide ions. Furthermore, PS macromolecules are subject to thermal degradation at elevated temperatures and this degradation renders the PS ineffective. It is well known that stabilization reactions of carbohydrates with PS occur at approximately the same temperature as the PS degradation reactions: i.e., at between 135 and 145° C. Thus, once PS begins to react with the carbohydrate within the fiber walls then subsequent reaction with PS will depend on subsequent diffusion into the chips and fiber walls. This diffusion limited process will be in direct competition with thermal degradation. Higher temperatures favor degradation.

It follows from the above that anything which increases the diffusion rate of PS will also increase its effectiveness by indirectly resulting in less loss of PS to thermal degradation. Increasing PS concentration will increase its diffusion rate. Similarly, insuring that PS is uniformly impregnated into the chips and fibers before reaching higher temperatures minimizes loss to thermal degradation and increases effectiveness. The retention time of chips and PS at temperatures between 135 and 145° C. is also likely to influence PS effectiveness. Finally, the benefits of AQ and PS are known to be synergistic and so the presence and concentration of AQ will also influence PS effectiveness.

In most industrial PS generation systems the PS is dissolved within the total white liquor stream fed to the digester. For conventional cooking processes all white liquor, and thus all PS, is introduced through the feed and can penetrate uniformly into chips and fiber within the impregnation zone (i.e., before being exposed to critical temperatures). On the other hand, for modified cooking processes a significant portion of white liquor, and thus PS, is diverted away from the feed and sent directly into the digester via a heating circulation. This PS will commence to thermally degrade immediately and so the effectiveness will be diminished. In general, most industrial scale digesters were not designed for high retention times in the 135 and 145° C. range. To some degree, the retention time of chips and PS at this temperature range can be controlled by altering process reaction conditions. The method and apparatus of the present invention displayed in FIG. 3 also optimizes the conditions under which polysulfide is most effective.

Figure 3:
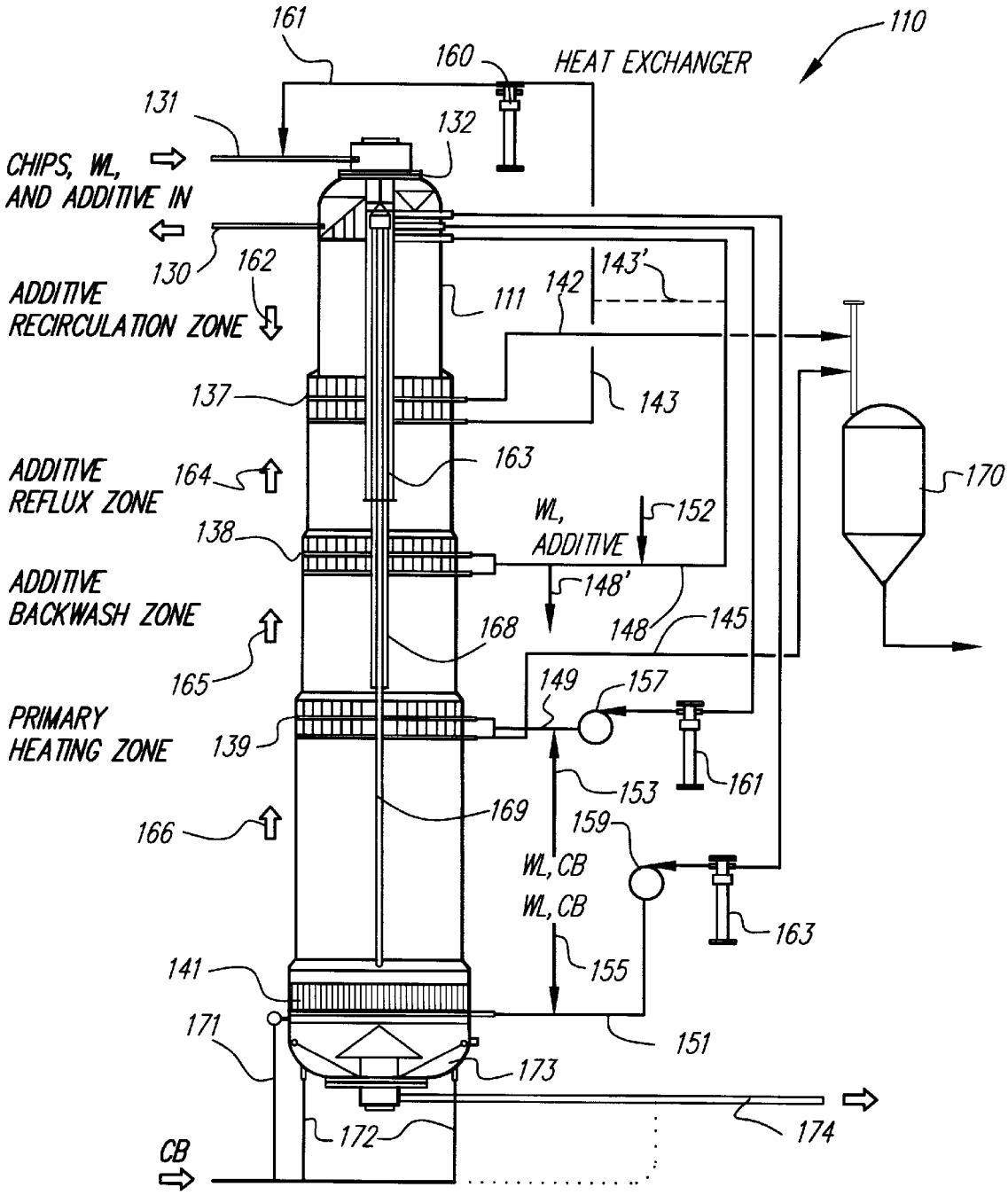
FIG. 3 is a view like that of FIG. 1 of a second embodiment.

In order to maximize or optimize the effectiveness of introducing an additive, such as anthraquinone, polysulfide, sulfur, surfactants, etc., and combination thereof, the present invention, marketed under the trademark LO-SOLIDS®-M2™ cooking, maximizes or optimizes the concentration of the additive and maximizes or optimizes the time the cellulose material is exposed to the additive (that is, the retention time) while minimizing the temperature of the treatment and minimizing the presence of dissolved organic material such as lignin. FIG. 3 schematically illustrates a preferred embodiment of the present invention.

The system 110 shown in FIG. 3 is similar to the system 10 shown in FIG. 1. However, unlike the system shown in FIG. 1, the FIG. 3 system includes only four screen assemblies 137, 138, 139 and 141, a recirculation heat exchanger 160, for heating or cooling, and a flash tank 170.

Similar to the operation of the system of FIG. 1, as shown in FIG. 3, a slurry of cellulose material, typically, wood chips, and liquid is introduced to digester 111 via conduit 131. Again, this slurry may have come from an upstream feed system pretreatment vessel, for example, an impregnation vessel. This slurry typically contains cooking chemical, for example, kraft white, green or black liquor, and may contain one or more additives as described above. The slurry in conduit 131 is typically at a temperature less than 140° C., preferably less than about 120° C.

When introduced to digester 111, excess liquor is removed from the slurry by liquor separator 132. The separator 132 may include a rotating screw-type element as schematically shown in the FIG. 1 embodiment, or may simply be an expansion in the flow, similar to a stilling well, that permits the solids to separate from the slurry so that the excess liquor can be removed by annular screens, as is conventional. The removed excess liquor is returned to the upstream vessel or feed system by conduit 130. Liquid may be introduced to the incoming slurry by conduit 161. The liquid in conduit 130 may be heated or cooled by heat exchanger 160 and may contain one or more additives or cooking liquor. For example, as shown the conduit 161 may contain liquor removed from a screen assembly 137 or screen assembly 138, via conduits 148 and 143', or from both screens 137 and 138, in the digester 111. In one embodiment, the recirculated liquor in conduit 161 is cooled by passing it in heat exchange relationship with a cooler liquid, for example, kraft white liquor which is heated prior to use. Though the present invention is applicable to any desired L/W ratio, after passing the separator 132, the slurry typically has a L/W ratio of between 2:1 to 5:1, preferably between 2:1 to 3:1 (and all narrower ranges within that broad range). Since some of the additive may be circulated to the slurry by conduit 160 and be present in the co-current zone (see arrow 162) between the top of the vessel 111 and screen 137, this zone is referred to as the "Additive Recirculation Zone."

After exiting the separator 132 the slurry enters the co-current impregnation zone (i.e., the additive recirculation zone) of the digester 111, as shown by arrow 162. (This zone may also be a counter-current treatment zone in which liquor removed via conduit 130, or a similar conduit, draws the free liquid upward past the downflowing chips.) In this zone, the cooking chemicals and additives are allowed to react with the cellulose material at a temperature less than 140° C. Upon reaching screen assembly 137 some of the liquor in the slurry is removed via conduit 142 and forwarded to chemical recovery or other uses via flash tank 170. (This liquor may be filtered to recover additive as shown by filter 82 in FIG. 1.) Some of the liquor in the slurry is also preferably removed by screen assembly 137 via conduit 143 and recirculated to conduit 131 via conduit 161 as described above. It is preferred that the liquor removed from the upper screen of screen assembly 137 (that is, the liquor containing lower levels of additive and higher levels of dissolved organic material) be forwarded to recovery and that the liquor from the lower screen (that is, the liquor containing more additive and a lower concentration of dissolved solids) be recirculated via conduit 143.

Below screen 137, the slurry encounters an upward flowing, or counter-current flow, of liquid containing one or more additives, as discussed above. This counter-current flow of liquid is schematically indicated by arrow 164. This liquid is drawn upward by the removal of liquid from screen 137 (or via conduit 130). After treatment with cooking liquor and additive (added at 152 and introduced via conduit 148), the slurry reaches screen 138. Cooking chemical (for example, white liquor, WL) and additive are introduced to the circulation conduit 148 associated with screen 138 by conduit 152. Conduit 148 contains liquid removed from the slurry via screen 138. This combination of extracted liquid, fresh cooking chemical, and additive is recirculated via conduit 148 and re-introduced to digester 111 in the vicinity of screen 138 by a conventional conduit, known as the "central pipe assembly", 163. Some of the liquid recirculated in conduit 148 may also be introduced to recirculation conduit 143 via conduit 143' such that some of the liquor removed from screen 138, containing additive, can be introduced to the incoming slurry in conduit 131. Also, some liquor may also be extracted from screen 138 via conduit 148' and used elsewhere or sent to chemical recovery, for example, via flash tank 170.

The temperature of the liquid between screens 137 and 138 is again typically maintained at a temperature less than 140° C. in order to prevent the thermal degradation or deactivation of the additive, such as polysulfide or anthraquinone. Though no heat exchanger is shown in circulation 148, a heat exchanger may be present in this circulation to heat or cool the liquor prior to re-introducing it. Circulation 148 may also include a pump (not shown) to pressurize the liquor.

The alkalinity, expressed as effective alkali (EA), of the liquor in the zone indicated by arrow 164 typically ranges from about 3 to 14 g/l expressed as NaOH, for example, the alkali concentration at or below screen 137 may be about 3 to 6 g/l as NaOH and the alkali concentration at or above screen 138 may be about 10 to 14 g/l as NaOH.

This control of the temperature and alkalinity of the slurry ensures that the cellulose is thoroughly treated with the desired additive prior to the slurry being exposed to the higher temperatures and alkalinities of the cooking zones below screen 138. This counter-current treatment zone between screen 137 and screen 138 is referred to as the "Additive Reflux Zone."

The Net Liquid Flow Rate (NLFR) in the Additive Reflux Zone, that is, between screens 137 and 138, is typically between about −2.0 and 2.0 T/T, preferably, between about −1.0 and 1.0 T/T, most preferably, between about −0.5 to 0.5 T/T, that is, as close to 0 as practical. Also, the NAC and M2 ratios for the zone between screens 137 and 138 are similar to those indicated above for the zone between screens 37 and 38 in FIG. 1.

Below screen 138 the slurry, which has been pretreated with an additive, for example, anthraquinone, encounters another counter-current zone, as indicated by arrow 165. This counter-current flow 165, which is typically hotter than the liquid above screen 138, for example, greater than 130° C., and has a higher EA concentration than the liquor above screen 138. For example, the alkali concentration of the liquor in the zone indicated by arrow 165 typically ranges from about 6 to 18 g/l as NaOH, for example, the alkali concentration at or below screen 138 may be about 6 to 8 g/l as NaOH and the alkali concentration at or above screen 139 may be about 14 to 18 g/l as NaOH. This displaced additive is typically removed by screen 138 and re-introduced to the slurry via central pipe assembly 163, such that the quantity of additive, such as anthraquinone, introduced to the hotter, more alkaline cooking zone below screen 139 is minimized. As noted above, liquor removed via screen 138 may also be recirculated to circulation 143 via conduit 143' or be removed via conduit 148' and used elsewhere. The liquor removed via conduits 143' and 148' may increase the "back-wash" flow below screen 138 such that a more thorough removal and recovery of additive can be achieved.

The temperature and alkalinity of the liquid between screen 138 and 139 is controlled by circulation 149 associated with screen 139. In the process shown in FIG. 3, the desired temperature and EA are effected by introducing cooking chemical (for example, white liquor, WL) and dilution liquor (for example, washer filtrate, also known as cold blow filtrate, CB) into circulation 149 via conduit 153. Circulation 149, which typically includes a pump 157 and a heat exchanger 161, re-introduces liquor to the vicinity of screen 139 by conduit 168, again, part of the central pipe assembly. Preferably, some of the liquid removed via screen 139 is removed via conduit 145 and forwarded to chemical recovery, via flash tank 170, or other use. It is preferred that the liquid removed from the lower screen of screen assembly 139 be removed via 145 to recovery and the liquor removed by the upper screen be recirculated via 149 to the digester 111. Since the counter-current flow 165 displaces the additive from the slurry, the treatment zone between screen 138 and screen 139 is referred to as the "Additive Backwash Zone".

The NLFR in the Additive Backflush Zone, that is, between screens 138 and 139 is typically between about −3.0 to 1.0 T/T, preferably, between about −3.0 to 0 T/T, most preferably, between about −2.0 and −1.0 T/T. Also, the NAC and M2 ratios for the zone between screens 138 and 139 are similar to those stated above for the zone between screens 38 and 39 of FIG. 1.

In addition to displacing the additive, the counter-current treatment 165 also heats the slurry to cooking temperature, that is, to a temperature greater than 140° C., preferably between 140° and 160° C., below screen 138, typically above screen 139. For this reason, this zone is referred to as the "Primary Heating Zone". Therefore, formal cooking or delignification commences at or below screen 138, typically above screen 139. In the system shown in FIG. 3, the heated slurry is then treated by a counter-current treatment below screen 139, as schematically shown by arrow 166. The counter-current flow of liquid is created by the removal of liquid from screen 139, and screen 138. The counter-current flow 166 is heated by circulation 151 associated with screen 141. Cooking chemical (WL) and dilution liquid (CB) are typically added to circulation 151 by conduit 155. The circulation 151 is typically pressurized by a pump 159 and heated by heat exchanger 163 prior to being re-introduced to the digester 111 in the vicinity of screen 141 by a conduit 169, which is part of the central pipe assembly Though the treatment shown below screen 139 in FIG. 3 is a counter-current treatment, the treatment may also be co-current. There may also be a co-current treatmnet followed by a counter curret treatment below screen 139, separated by one or more further screen assemblies, such as screen assemblies 40 in FIG. 1.

The essentially fully-treated cellulose (pulp) that passes screen 141 is cooled and washed with liquid (again, for example, cold blow filtrate) introduced by one or more conduits 171, 172. The cooler cellulose material is discharged from the vessel by an agitating discharge device 173 into conduit 174 and forwarded to further treatment, for example, to brown stock washing.

The exemplary treatment time in each of the above zones is as follows (including all narrower ranges within each of the following broad ranges): Additive reflux zone about 20–60 minutes; additive backwash zone about 10–60 minutes; and primary heating zone about 5–60 minutes.

The significant features of the present invention as disclosed in FIG. 3, which distinguish the present invention from the prior art, include:

(1) multiple additive, white liquor, and filtrate addition points along with multiple extraction sites;

(2) a con-current impregnation zone which can include internally re-circulated liquor;

(3) a post impregnation extraction wherein the low molecular weight material (e.g. lignin) dissolved during impregnation is purged out of the system;

(4) a low temperature, counter-current additive "reflux zone" beneath the post impregnation extraction site;

(5) a dedicated circulation for additive, white liquor and filtrate addition (i.e. not simultaneously used for heating);

(6) a low temperature, counter-current "additive backwash" zone beneath the addition circulation; and (7) a primary heating circulation located downstream of the additive backwash zone.

Figure 5:
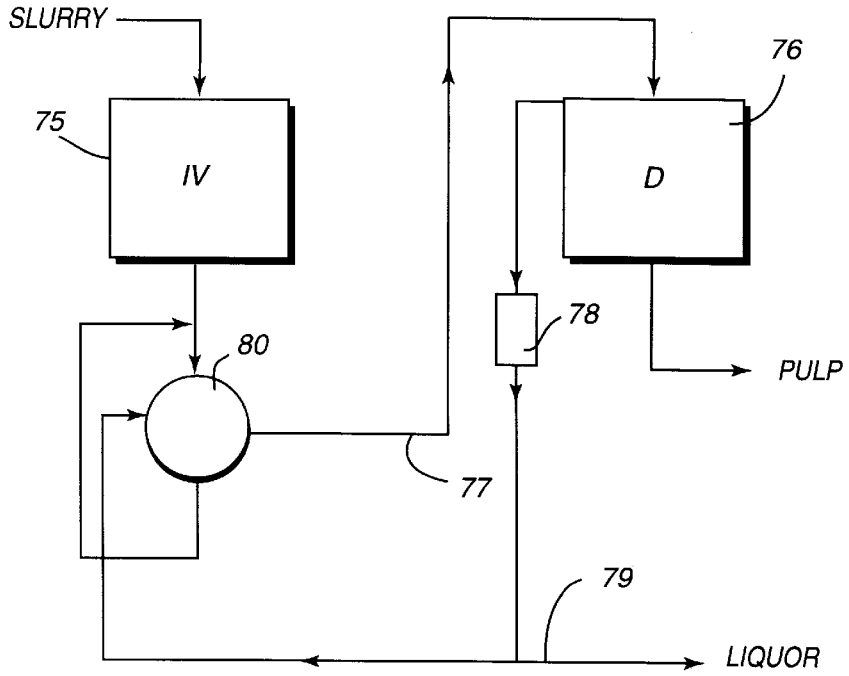
FIG. 5 is a schematic representation of a two (or more) vessel system utilizable for either of the embodiments of FIGS. 1 and 3.

If desired, the treatments zones can take place in different vessels. For example, as seen in FIG. 5, the additive reflux zone and additive backflush zone can be located in a first vessel, e.g., an impregnation vessel 75, and the primary heating and cooking can be performed in a second vessel, for example, a digester 76. In addition, the primary heating may also be performed during the transfer between vessels 75, 76 via a heated transfer circulation 77, e.g. containing an indirect heater 78, and high pressure feeder 80, and cooking can be performed in the second vessel 76. Liquor can also be removed from the transfer circulation 77, as indicated schematically at 79 in FIG. 5.

Figure 4:
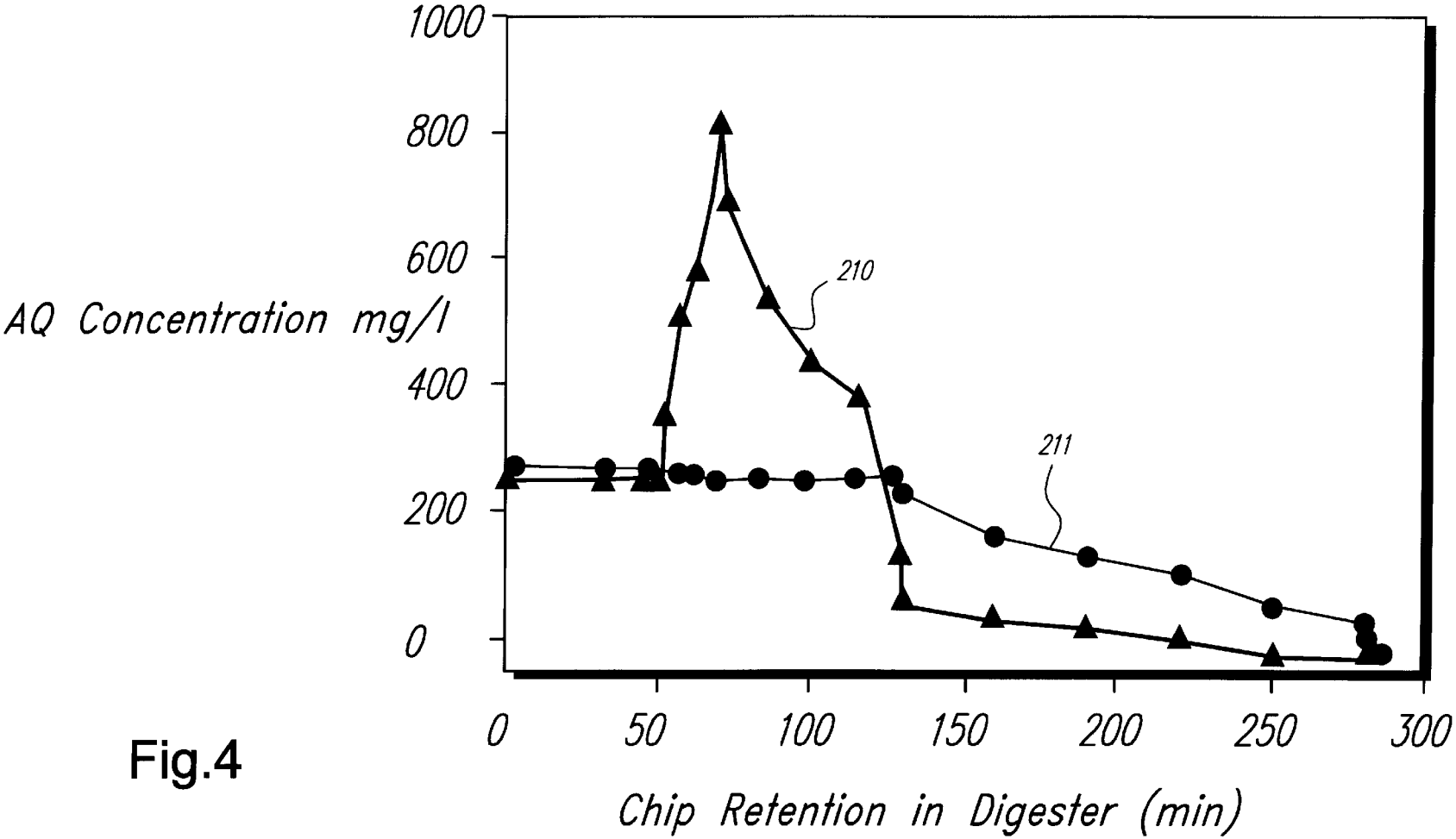
FIG. 4 is a graph like that of FIG. 2 only for the embodiment of FIG. 3 as far as the plot according to the invention is concerned.

FIG. 4 compares the predicted AQ concentration profile according to the present invention to the profile of a typical conventional continuous cooking configuration. Again, the predicted profiles are based upon process simulation assuming steady-state; for all cases the AQ charge was assumed to be 0.1% on wood. For the profile for the simulation of the process according to the present invention, 210 in FIG. 4, conditions were arbitrarily set to have the concentration in the impregnation zone match that of the conventional configuration. With this constraint in place, the model predicts as much as a 300% increase in AQ concentration (within the additive refluxing zone between screens 137, 138) for the same total AQ charge compared to the profile of the conventional process 211. The post impregnation extraction and the delay of rise to temperature also mean that both temperature and dissolved organic material concentration are low within the reflux zone of the process of the present invention. Compared to the conventional process, the concentration of dissolved lignin is 40% lower beneath the upper cooking screen (screen assembly 137 of FIG. 3) for the process of the present invention. Thus, greater than 500% increases in the ratio of AQ concentration to dissolved lignin can be achieved while maintaining similar reaction conditions in the impregnation zone when the present invention is used.

It is important to note that the relative concentrations of AQ in the impregnation zone (between the separator 132 and screen 137 of FIG. 3) and in the reflux zone (between screens 137 and 138 of FIG. 3) of a digester according to the present invention are easily manipulated by altering the split of AQ to the feed upstream of the digester 111 and to the additive addition circulation (circulation 148 of FIG. 3). For example, if 100% of the AQ charge where added to circulation 148 then the peak concentration in the impregnation zone (between the separator 132 and screen 137) and the reflux zone (between screens 137 and 138) would be on the order of 150 and 1200 mg/l, respectively. The internal re-circulation of liquor to the feed is the source of AQ in impregnation under these circumstances. The optimal time-concentration profile of AQ is simply not known at this point in time. The interactive effects of PS, sulfur, surfactants, and other additives, and dissolved organic material, including lignin, and the temperature profiles complicate this analysis.

Figure 6:
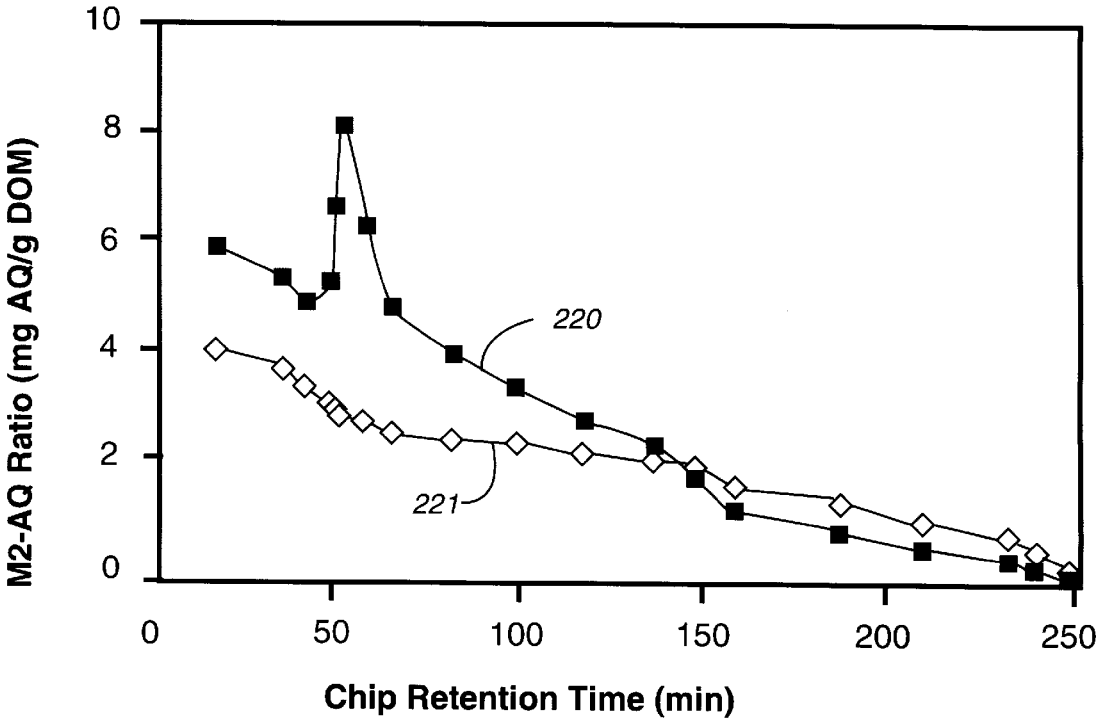
FIG. 6 is a graphical depiction of a theoretical indication of an M2-AQ Ratio according to the present invention.

However, as discussed previously, the present invention desirably provides a maximum additive concentration while minimizing the concentration of dissolved organic material (DOM) (i.e., dissolved lignin, dissolved cellulose, etc.). As also discussed earlier, the ratio of the concentration of additive to the concentration of DOM, coined herein as the "M2 Ratio", provides a relative indication of the concentrations of the additive and the DOM. FIG. 6 presents a theoretical indication of the M2 Ratio for treatment with the anthraquinone, that is, the "M2-AQ Ratio", according to the present invention. In FIG. 6, the curve 220 is the M2-AQ ratio according to the invention, while the curve 221 is the M2-AQ ratio according to the prior art continuous digester.

In the illustrated embodiments of the invention in FIGS. 1 and 3, the means for recirculating liquor containing displaced yield or strength containing additive from the first set of screens 37, 137 to the slurry above the first set of screens 37, 137 preferably includes a conduit, such as the conduit 70 in FIG. 1 and 143 in FIG. 3, which reintroduces liquor containing displaced additive either back into the vessel 11 (as seen in FIG. 1), or even before the inlet and separator 132 (as seen by the line 161 in FIG. 3). The recirculation means may also comprise a heat exchanger for heating or cooling (such as 160 in FIG. 3), a pump if necessary, a further additive introduction conduit, or the like. Also any other conventional structure for recirculating a liquor may be utilized as the recirculating means.

Also according to the invention, the means for establishing a counter-current upward flow of liquid substantially between the first and second set of screens 137, 138, 37, 38, respectively, including the first set of screens 37, 137 and a first zone, may be the withdrawal of liquid from the first set of screens 37, 38, which causes the upward flow of liquid; the central pipe assembly 163; and/or the conduit 48, 148, or any other conventional structure that can accomplish that function.

In the embodiments of FIGS. 1 and 3 the means for introducing the yield or strength enhancing additive into the vessel 11, 111 adjacent the second set of screens 38, 138 to flow upwardly with liquid in the first zone may comprise a simple conduit 52, 152, or an injection nozzle or port or orifice, a pressurized system, or any other conventional structure for introducing an additive into a stream of liquid. The additive can also be introduced without the benefit of a annular screen assembly. For example, the liquid containing an additive can be introduced via a centrally-located discharge in a counter-current treatment zone from, for example, a central pipe assembly, without the presence of an annular screen assembly. This is one method of practicing the present invention in an existing digester having only two screen assemblies, and not the three screen assemblies shown in FIGS. 1 and 3.

In the embodiments of FIGS. 1 and 3 the means, including the second set of screens 38, 138, for providing a counter-current flow of liquor to the slurry in a second zone (the additive backwash zone as indicated by arrow 165 in FIG. 3 and the zone indicated by arrows 68, 69 in FIG. 1) between the second and third sets of screens 38, 39, 138, 139, may include withdrawal of liquid at the screens 38, 138 either by natural circulation or using a pump, a recirculatory loop, and/or a heat exchanger (for heating or cooling the liquid withdrawn), liquid introduction in the area adjacent the third screen set 39, 139, and/or any other conventional structure that can accomplish that function.

Thus, according to the present invention a method and apparatus for producing cellulose pulp from a cellulose material is provided in which the material can be pretreated with an alkali- or temperature-sensitive additive which maximizes or optimizes the effectiveness of the treatment and minimizes the degradation, destruction, and loss of the additive to the pulping process and pulp. In the description of the invention it is to be understood that all broad ranges include all the narrower ranges within each broad range. For example the temperature range of 130–145° C. includes the ranges 131–142, 130–140, 135–145, and all other narrower ranges.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of continuously producing chemical cellulose pulp from comminuted cellulosic fibrous material slurry, with a yield or strength increase, comprising:

(a) continuously treating the comminuted cellulosic fibrous material slurry with a solution containing yield or strength-enhancing additive so that the material and additive flow for a predetermined period of time in contact with each other; after (a);

(b) continuously displacing the majority of the additive from the slurry by substantially continuous counter-current treatment thereof prior to bulk delignification and removing the additive from contact with the material; and then (c) continuously treating the material with an alkaline cooking liquor, at cooking temperature, to produce a cellulose pulp with higher yield or strength than if (a) were not practiced.

2. A method as recited in claim 1 wherein (a) and (c) are practiced so as to increase yield by at least 2% compared to if (a) were not practiced.

3. A method as recited in claim 2 wherein (a) is practiced using AQ or AQ derivatives, or a combination of AQ and/or AQ derivatives and other chemicals.

4. A method as recited in claim 3 wherein (a) is practiced at a temperature below 140° C.

5. A method as recited in claim 4 wherein the alkalinity at the start of (a) is about 3–6 g/l expressed as NaOH and at the end of (a) is about 6–18 g/l.

6. A method as recited in claim 1 wherein (c) is practiced using kraft white liquor, green liquor, black liquor, soda cooking liquor, polysulfide containing liquor, or combinations thereof, as the cooking liquor, and is practiced at a temperature above 140° C.; and wherein (a)–(c) are practiced to provide a yield of at least 3% higher than the yield produced by methods not employing (a) and (b).

7. A method as recited in claim 1 wherein (b) is practiced at a temperature of between 130–150° C.

8. A method as recited in claim 1 further comprising taking AQ containing liquor displaced in (b) and reintroducing it to the slurry in (a).

9. A method as recited in claim 1 wherein (a)–(c) are practiced so as to keep the Net Liquid Flow Rate during (a) in the range of about −2.0 to 2.0 tons of liquid per ton of pulp and during (b) in the range of about −3.0 to 1.0 tons of liquid per ton of pulp.

10. A method as recited in claim 1 wherein (a)–(c) are practiced so as to keep the Net Liquid Flow Rate during (a) in the range of about −0.5 to 0.5 tons of liquid per ton of pulp and during (b) in the range of about −2.0 to −1.0 tons of liquid per ton of pulp.

11. A method as recited in claim 10 wherein (a) is practiced so that the Net Additive Concentration is at least about 0.0015 tons of additive per ton of pulp and the Dissolved Organic Material Ratio is, or is equivalent to, a Dissolved Organic Material-AQ ratio of at least about 5.0 mg/g.

12. A method as recited in claim 10 wherein (a) is practiced so that the Net Additive Concentration is at least about 0.0020 tons of additive per ton of pulp and the Dissolved Organic Material Ratio is, or is equivalent to, a Dissolved Organic Material-AQ ratio of at least about 6.0 mg/g.

13. A method as recited in claim 10 wherein (a)–(c) are practiced so as to keep the Net Liquid Flow Rate during (a) in the range of about −0.5 to 0.5 tons of liquid per ton of pulp and during (b) in the range of about −2.0 to −1.0 tons of liquid per ton of pulp.

14. A method as recited in claim 13 wherein (a) is practiced so that the Net Additive Concentration is at least about 0.0015 tons of additive per ton of pulp and the Dissolved Organic Material Ratio is, or is equivalent to, a Dissolved Organic Material-AQ ratio of at least about 5.0 mg/g.

15. A method as recited in claim 1 wherein (a) is practiced using AQ or AQ derivatives, or a combination of AQ or AQ derivatives and other chemicals; and (a) is practiced at a temperature below 140° C., and (b) is practiced at a temperature of between about 130–150° C.

16. A method as recited in claim 15 further comprising taking AQ containing liquor displaced in (b) and reintroducing it to the slurry in (a).

17. A method as recited in claim 1 wherein (a) is practiced so that the Net Additive Concentration is at least 0.0010 tons of additive per ton of pulp and the Dissolved Organic Material Ratio is, or is equivalent to, a Dissolved Organic Material-AQ ratio of at least 4.0 mg/g.

18. A method as in claim 1 wherein at least (a) is practiced in a first vessel and (c) is practiced in a second vessel.

19. A method as in claim 1 wherein (a) is preceded by (d) pretreating the cellulose material with an alkaline liquid, with or without the presence of an additive.

20. A method as in claim 19 wherein (d) is a co-current treatment and is performed at a temperature less than 130° C.

21. A method as in claim 19, wherein (d) is a counter-current treatment, and is performed at a temperature less than 130° C.

22. A method as in claim 19 wherein (d) is an impregnation at a temperature less than 130° C.

23. A method of continuously producing chemical cellulose pulp from comminuted cellulosic fibrous material slurry, with a yield or strength increase, comprising:

(a) continuously treating the comminuted cellulosic fibrous material slurry with a solution containing yield or strength-enhancing additive;

(b) after (a) continuously displacing liquor containing at least some of the additive from (a) in a continuous counter-current treatment zone;

(c) continuously recirculating liquor containing displaced additive from (b) to the slurry in (a); and, after (b), (d) continuously treating the material with an alkaline cooking liquor, at cooking temperature, to produce a cellulose pulp with higher yield or strength than if (a) were not practiced.

24. A method as recited in claim 23 wherein (a) is practiced using AQ, AQ derivatives, PS, $NaBH_4$, sulfur, combinations thereof, or combinations thereof with other chemicals.

25. A method as recited in claim 23 wherein (a) is practiced using AQ or AQ derivatives, or a combination of AQ or AQ derivatives and other chemicals; and (a) is practiced at a temperature below about 140° C., and (b) is practiced at a temperature of between about 130–150° C.

26. A method as recited in claim 23 wherein (b) is practiced at a temperature between 130–150° C., and wherein (a)–(c) are practiced so as to keep the Net Liquid Flow Rate during (a) in the range of about −2.0 to 2.0 tons of liquid per ton of pulp and during (b) in the range of about −3.0 to 1.0 tons of liquid per ton of pulp.

27. A method of continuously producing chemical cellulose pulp from comminuted cellulosic fibrous material slurry, with a yield or strength increase, comprising:

(a) pretreating the cellulose material with an alkaline liquid, with or without the presence of an additive;

(b) after (a), removing at least some of the free liquor from the slurry;

(c) after (b), treating the comminuted cellulosic fibrous material slurry with a solution containing yield or strength-enhancing additive;

(d) displacing the majority of the additive from the slurry by substantially continuous counter-current treating thereof prior to bulk delignification; and (e) treating the material with an alkaline cooking liquor, at cooking temperature to produce a cellulosic pulp with a higher yield or strength than if (c) were not practiced.

28. A method as in claim 27 wherein (b) is a post-impregnation extraction which removes liquid containing dissolved organic material produced during (a) so that the concentration of dissolved organic material is minimized prior to (c).

29. A method as in claim 28 wherein some of the liquid removed during (b) contains useful additive, and further comprising re-introducing the liquid removed during (b) to the cellulose material prior to or during (a).

* * * * *